US007869745B2

(12) United States Patent
Nishiyama et al.

(10) Patent No.: US 7,869,745 B2
(45) Date of Patent: Jan. 11, 2011

(54) DEVELOPING DEVICE HAVING AN AGITATING MEMBER AND IMAGE FORMING APPARATUS USING SAME

(75) Inventors: Kazuhiro Nishiyama, Matsumoto (JP); Tsutomu Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 56 days.

(21) Appl. No.: 12/368,881

(22) Filed: Feb. 10, 2009

(65) Prior Publication Data

US 2009/0220283 A1 Sep. 3, 2009

(30) Foreign Application Priority Data

Feb. 28, 2008 (JP) ..... 2008-048231
Oct. 10, 2008 (JP) ..... 2008-263951

(51) Int. Cl.
*G03G 15/10* (2006.01)

(52) U.S. Cl. ..... 399/238; 399/239

(58) Field of Classification Search ..... 399/237–239, 399/249

See application file for complete search history.

(56) References Cited

U.S. PATENT DOCUMENTS 7,167,666 B2 * 1/2007 Munakata et al. ..... 399/237

FOREIGN PATENT DOCUMENTS

JP 2007-147973 6/2007

* cited by examiner

*Primary Examiner*—Hoang Ngo
(74) *Attorney, Agent, or Firm*—DLA Piper LLP (US)

(57) ABSTRACT

A developing device includes: a developer carrying body that carries liquid developer containing toner and carrier liquid; a developer supplying member adapted to rotate in a first sense of rotation to supply liquid developer to the developer carrying body; a contact member arranged at a first side relative to a virtual perpendicular plane passing through the axis of the developer supplying member so as to contact the developer supplying member; a supply section that stores liquid developer to be supplied by the developer supplying member to the developer carrying body; and an agitating member adapted to rotate in a second sense of rotation different from the first sense of rotation and arranged at a second side relative to the virtual perpendicular plane passing through the axis of the developer supplying member.

15 Claims, 19 Drawing Sheets

DEVELOPING DEVICE HAVING AN AGITATING MEMBER AND IMAGE FORMING APPARATUS USING SAME

CROSS REFERENCE TO RELATED APPLICATIONS

This application is based upon and claims the benefit of priority from prior Japanese Patent Application No. 2008-048231, filed Feb. 28, 2008, and No. 2008-263951, filed Oct. 10, 2008, the entire contents of which are incorporated herein by reference.

BACKGROUND

1. Technical Field

The present invention relates to a developing device and an image forming apparatus using liquid developer prepared by dispersing toner in carrier liquid.

2. Description of the Related Art

Structures having a tank section storing liquid developer and a primary reservoir section with a partition wall arranged between the tank section and the reservoir section in a developing unit are known.

With such a structure, liquid developer is discharged into the primary reservoir section over the partition wall when the quantity of the liquid developer stored in the tank section for storing liquid developer to be supplied to a developing roller exceeds a predetermined level. The structure has a circulation route such that the liquid developer in the primary reservoir section is subsequently collected into a developer adjusting section and adjusted for concentration before it is returned to the tank section by way of the circulation route.

However, with the technique described in Patent Document 1 (JP-2007-147973A), liquid developer is deposited in the space between a limiting blade and a developer supply roller arranged below the limiting blade by an agitation roller to give rise to a pressure rise relative to the limiting blade and the deposited liquid developer can adversely affect the thickness of the film on the developing roller and consequently put the liquid developer being supplied onto the photosensitive body out of balance to degrade the quality of the formed image.

SUMMARY

According to an aspect of the invention, the above-identified problem is dissolved by providing a developing device and an image forming apparatus that can stabilize the supply of liquid developer to the developer carrying body by means of the developer supply roller to produce high quality images at low cost without requiring any additional member and remarkable alteration to the arrangement.

According to an aspect of the invention, the above object is achieved by providing a developing device including: a developer carrying body for carrying liquid developer containing toner and carrier liquid; a developer supplying member adapted to rotate in a first sense of rotation to supply liquid developer to the developer carrying body; a contact member arranged at a first side relative to a virtual perpendicular plane passing through the axis of the developer supplying member so as to contact the developer supplying member; a supply section for storing liquid developer to be supplied by the developer supplying member to the developer carrying body; and an agitating member adapted to rotate in a second sense of rotation different from the first sense of rotation and arranged at a second side relative to the virtual perpendicular plane passing through the axis of the developer supplying member.

Preferably, in the developing device according to an aspect of the invention as defined above, the agitating member has: a first helical blade arranged to extend from a central part to a first end of the agitating member; and a second helical blade arranged to extend from the central part to a second end of the agitating member.

Preferably, in the developing device according to an aspect of the invention as defined above, the agitating member has: a third helical blade arranged at the first end; and a fourth helical blade arranged at the second end.

Preferably, in the developing device according to an aspect of the invention as defined above, the agitating member has a rib arranged in the axial direction.

Preferably, the developing device according to an aspect of the invention as defined above further includes: a developer carrying body cleaning member for cleaning the developer carrying body to remove the liquid developer carried by the developer carrying body; a collecting section for collecting the liquid developer removed by the developer carrying body cleaning member; and a wall section arranged between the supply section and the collecting section.

Preferably, in the developing device according to an aspect of the invention as defined above, the collecting section has: a conveying member for conveying the liquid developer collected by the developer carrying body cleaning member; and a developing device collecting channel connected to an end of the conveying member of the collecting section.

According to an aspect of the invention, there is also provided an image forming apparatus including: a developing section having: a developer carrying body for carrying liquid developer containing toner and carrier liquid; a developer supplying member adapted to rotate in a first sense of rotation to supply liquid developer to the developer carrying body; a contact member arranged at a first side relative to a virtual perpendicular plane passing through the axis of the developer supplying member so as to contact the developer supplying member; a supply section for storing liquid developer to be supplied by the developer supplying member to the developer carrying body; and an agitating member adapted to rotate in a second sense of rotation different from the first sense of rotation and arranged at a second side relative to the virtual perpendicular plane passing through the axis of the developer supplying member;

an exposure section for forming a latent image; a latent image carrying body for developing the latent image formed by the exposure section by means of the developer carrying body; and a transfer member for receiving the image developed by the latent image carrying body and transferred thereto.

Preferably, in the image forming apparatus according to an aspect of the invention as defined above, the agitating member has: a first helical blade arranged to extend from a central part to a first end of the agitating member; and a second helical blade arranged to extend from the central part to a second end of the agitating member.

Preferably, in the image forming apparatus according to an aspect of the invention as defined above, the agitating member has: a third helical blade arranged at the first end; and a fourth helical blade arranged at the second end.

Preferably, in the image forming apparatus according to an aspect of the invention as defined above, the agitating member has a rib arranged in the axial direction.

Preferably, the image forming apparatus according to an aspect of the invention as defined above further includes: a developer carrying body cleaning member for cleaning the developer carrying body to remove the liquid developer carried by the developer carrying body; a collecting section for collecting the liquid developer removed by the developer carrying body cleaning member; and a wall section arranged between the supply section and the collecting section.

Preferably, in the image forming apparatus according to an aspect of the invention as defined above, the collecting section has: a conveying member for conveying the liquid developer collected by the developer carrying body cleaning member; and a developing device collecting channel connected to an end of the conveying member of the collecting section.

Preferably, the image forming apparatus according to an aspect of the invention as defined above further includes: a squeezing member held in contact with the latent image carrying body where the latent image is developed by the developing section to squeeze off the image.

Thus, the developing device according to an aspect of the invention as defined above can supply liquid developer to the developer carrying body by means of the developer supplying member without requiring any additional member and any alteration of the configuration.

Additionally, the developing device according to an aspect of the invention as defined above can agitate liquid developer so as to make it pervade the inside of the supply section.

Still additionally, the developing device according to an aspect of the invention as defined above can suppress any excessive quantity of liquid developer in the supply section.

Still additionally, the developing device according to an aspect of the invention as defined above can smoothly collect liquid developer.

Still additionally, the image forming apparatus according to an aspect of the invention as defined above can form high quality images and can be provided at low cost.

Still additionally, in the image forming apparatus according to an aspect of the invention as defined above, the liquid developer in the collecting section is made to flow with ease without requiring any additional member so that the image forming apparatus can be downsized and manufactured at low cost.

Furthermore, in the image forming apparatus according to an aspect of the invention as defined above, the liquid developer on the surface of the developer carrying body cleaning member is made to flow with ease without requiring any additional member so that the image forming apparatus can be downsized and manufactured at low cost.

Still other objects and advantages of the invention will in part be obvious and will in part be apparent from the specification.

The invention accordingly comprises the features of construction, combinations of elements and arrangement of parts which will be exemplified in the construction hereinafter set forth and the scope of the invention will be indicated in the claims.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
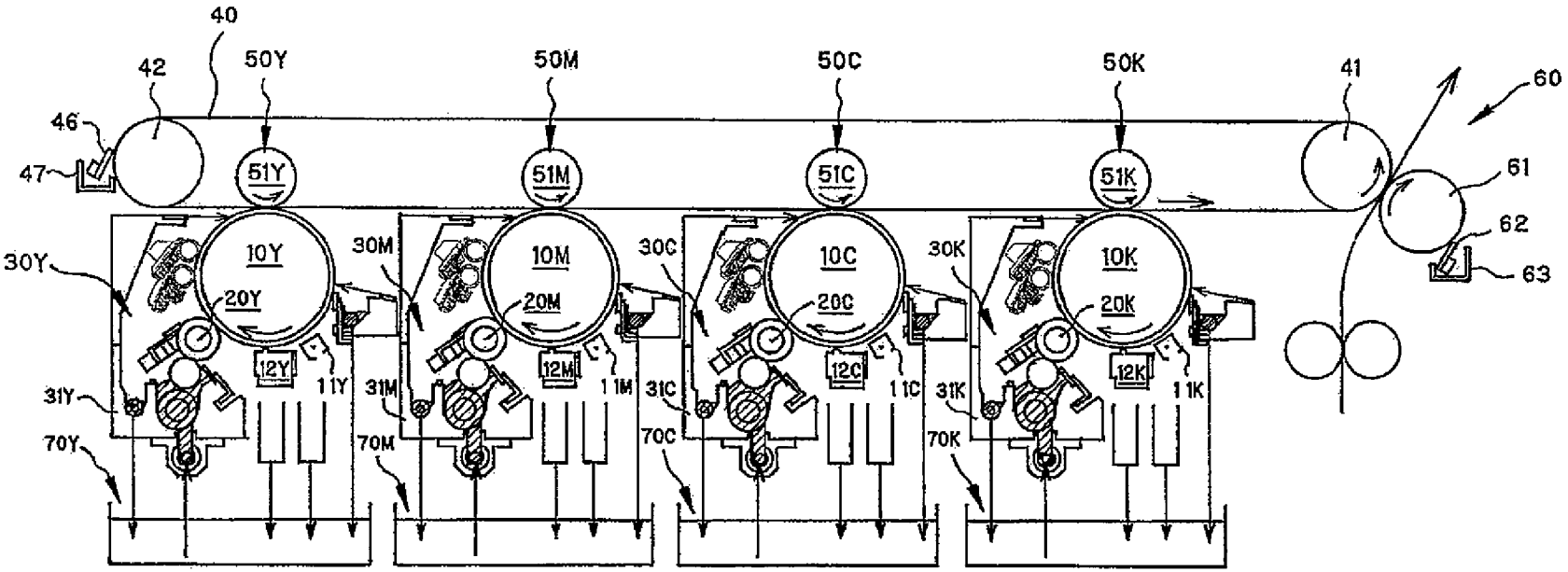
FIG. 1 is a schematic illustration of image forming apparatus according to an embodiment of the present invention.

Now, the present invention will be described by referring to the accompanying drawings that illustrate an embodiment of the invention. FIG. 1 is a schematic illustration of an embodiment of image forming apparatus according to the present invention, showing principal components thereof. Latent image carrying bodies 10Y, 10M, 10C and 10K of different colors are arranged in a central part of the image forming apparatus, whereas development units 30Y, 30M, 30C and 30K and developer collecting/supplying devices 70Y, 70M, 70C and 70K, which operate as so many developing devices, are arranged in a lower part of the image forming apparatus and an intermediate transfer belt 40, which operates as an intermediate transfer member, and a secondary transfer section 60 are arranged in an upper part of the image forming apparatus.

Electric chargers 11Y, 11M, 11C and 11K and exposure units 12Y, 12M, 12C and 12K are arranged around the respective latent image carrying bodies 10Y, 10M, 10C and 10K. Exposure units 12Y, 12M, 12C and 12K are formed by so many line heads realized by arranging LEDs. The latent image carrying bodies 10Y, 10M, 10C and 10K are electrically uniformly charged by the respective electric chargers 11Y, 11M, 11C and 11K and laser beams that are modulated according to the input image signal are respectively irradiated onto them by the exposure units 12Y, 12M, 12C and 12K to form electrostatic latent images on the electrically charged latent image carrying bodies 10Y, 10M, 10C and 10K.

The development units 30Y, 30M, 30C and 30K respectively include developing rollers 20Y, 20M, 20C and 20K that are developer carrying bodies, developer containers 31Y, 31M, 31C and 31K storing liquid developers of yellow (Y), magenta (M), cyan (C) and black (K) and developer supply rollers 32Y, 32M, 32C and 32K that are developer supply members for supplying liquid developers from the developer containers 31Y, 31M, 31C and 31K to the developing rollers 20Y, 20M, 20C and 20K as well as other components so as to develop the electrostatic latent images formed on the latent image carrying bodies 10Y, 10M, 10C and 10K by means of liquid developers of the respective colors.

The intermediate transfer belt 40 is an endless belt member. It is wound between a drive roller 41 and a tension roller 42 and driven to rotate by the drive roller 41, while contacting the latent image carrying bodies 10Y, 10M, 10C and 10K respectively at primary transfer sections 50Y, 50M, 50C and 50K. In the primary transfer sections 50Y, 50M, 50C and 50K, primary transfer rollers 51Y, 51M, 51C and 51K are arranged respectively opposite to the latent image carrying bodies 10Y, 10M, 10C and 10K with the intermediate transfer belt 40 interposed between them so that the developed toner images of the different colors on the late image carrying bodies 10Y, 10M, 10C and 10K are transferred onto the intermediate transfer belt 40 at the respective transfer positions that are the contact positions of the primary transfer rollers 51Y, 51M, 51C and 51K with the latent image carrying bodies sequentially one on the other to form a full color toner image.

In a secondary transfer unit 60, the secondary transfer roller 61 is arranged opposite to a belt drive roller 41 with the intermediate transfer belt 40 interposed between them and provided with a cleaning device including a secondary transfer roller cleaning blade 62 and a developer collecting section 63. In the secondary transfer unit 60, a sheet member that may be a sheet of paper, film or cloth is conveyed and supplied by way of a sheet member conveying route L to the transfer position of the secondary transfer unit 60 in synchronism with the arrival of the full color toner image formed by color superposition or the monochrome toner image formed on the intermediate transfer belt 40 to the transfer position of the secondary transfer unit 60 so that the full color toner image or the monochrome toner image is transferred onto the sheet member for secondary transfer. A fixing unit (not shown) is arranged downstream on the sheet member conveying route L to melt and fix the full color toner image or the monochrome toner image transferred onto the sheet member to finally complete the process of forming an image on the sheet member (recording medium).

The tension roller 42 is located opposite to the belt drive roller 41 and the intermediate transfer belt 40 is wound around them. At the side of the tension roller 42, a cleaning device including an intermediate transfer belt cleaning blade 46 and a developer collecting section 47 is arranged around the outer periphery of the tension roller 42. Thus, after passing the secondary transfer unit 60, the intermediate transfer belt 40 proceeds to the belt winding part of the tension roller 42 and the surface of the intermediate transfer belt 40 is cleaned by the intermediate transfer belt cleaning blade 46 before it moves toward the primary transfer section 50 once again.

The developer collecting/supplying devices 70Y, 70M, 70C and 70K respectively adjust the concentrations of the liquid developers collected from the latent image carrying bodies 10Y, 10M, 10C and 10K and the development units 30Y, 30M, 30C and 30K and supply them to the developer containers 31Y, 31M, 31C and 31K.

Figure 2:
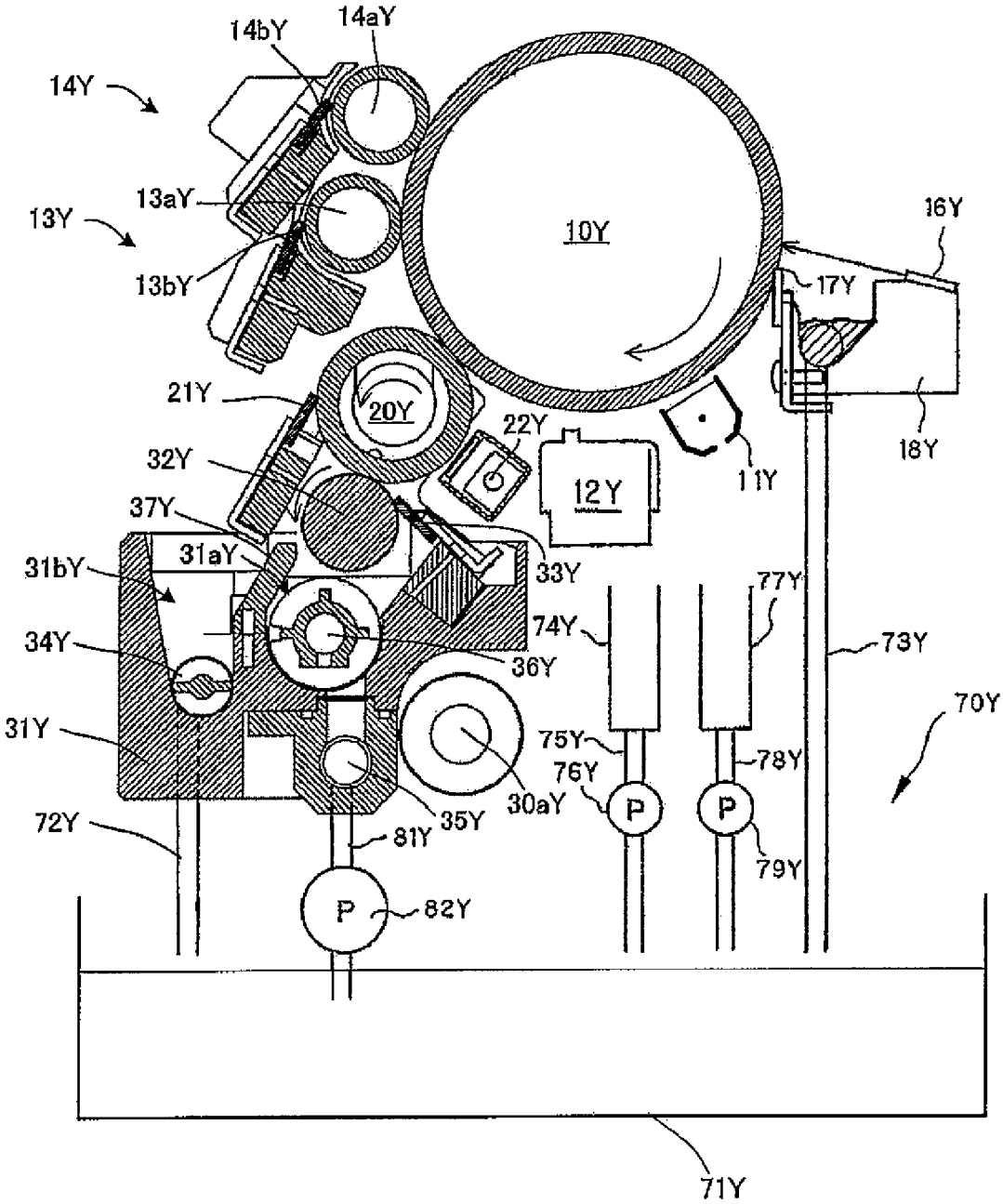
FIG. 2 is a cross-sectional view of the latent image carrying body and the development unit, showing principal components thereof.
Figure 3:
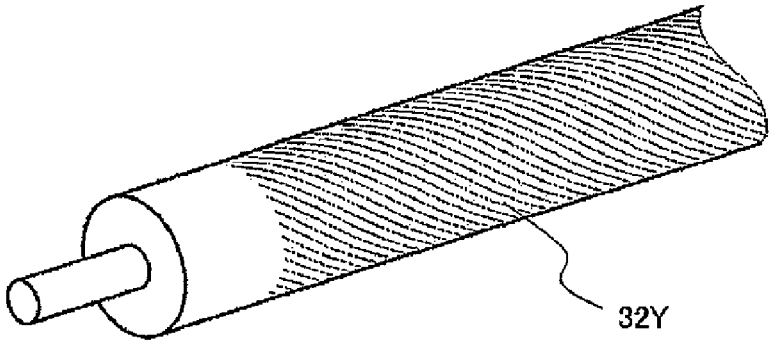
FIG. 3 is a schematic perspective view of the developer supplying member of the embodiment.
Figure 4:
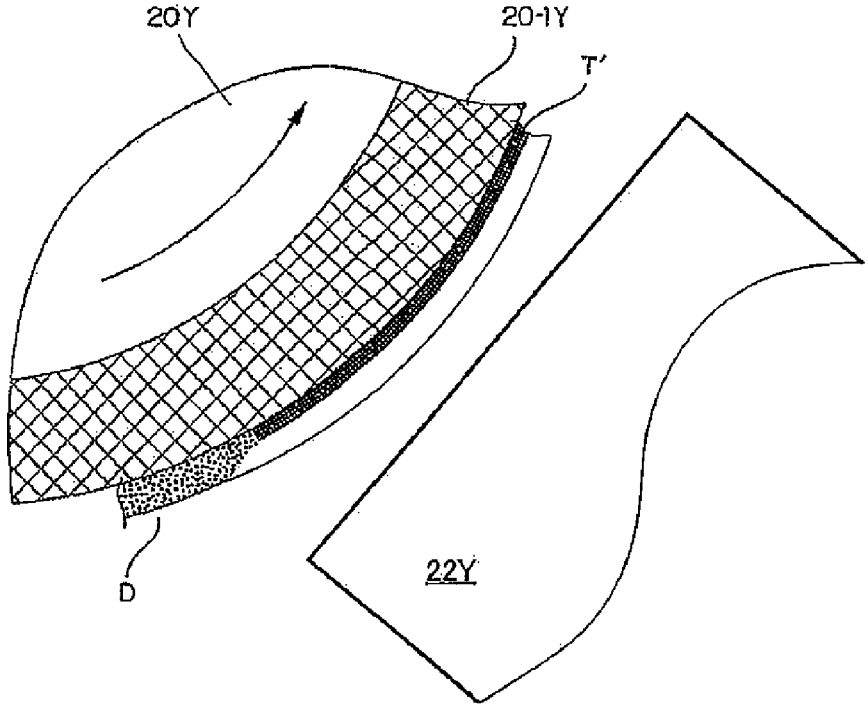
FIG. 4 is a schematic illustration of compression of developer by the developer compressing device of the embodiment.
Figure 5:
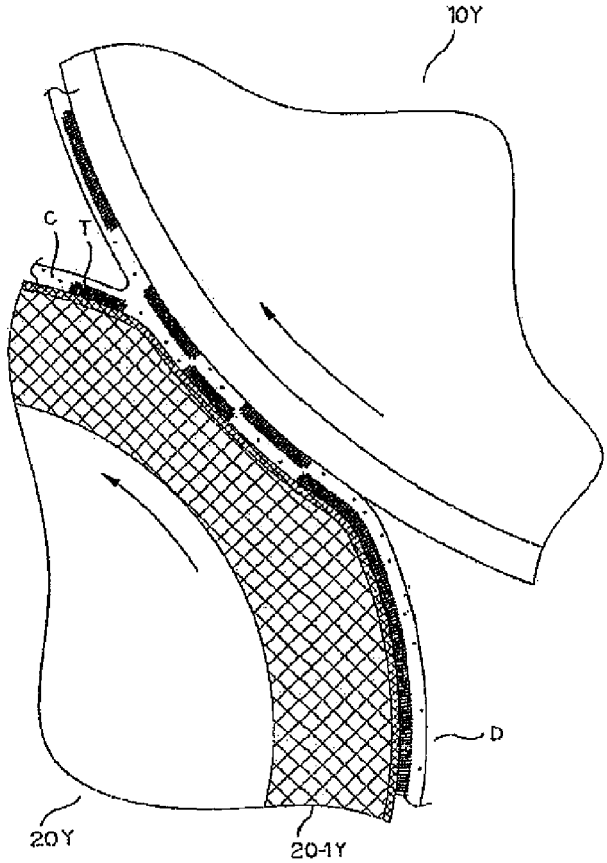
FIG. 5 is a schematic illustration of development by the developing roller of the embodiment.
Figure 6:
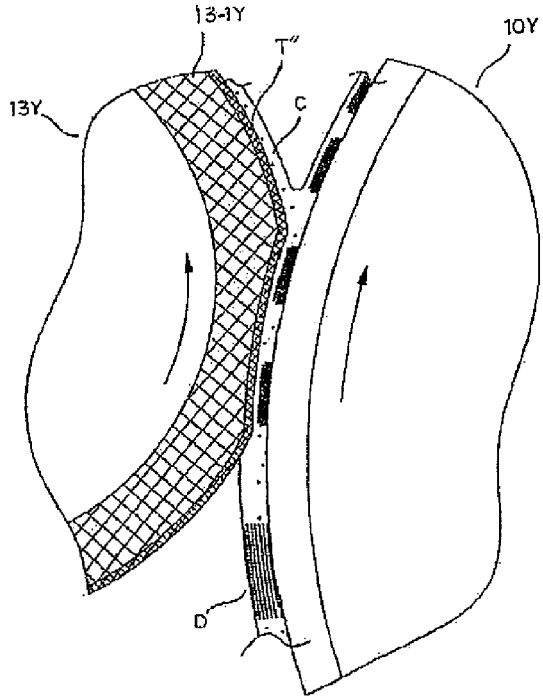
FIG. 6 is a schematic illustration of the squeezing effect of the squeezing roller of the embodiment.

Now, the latent image carrying bodies 10Y, 10M, 10C and 10K and the development units 30Y, 30M, 30C and 30K will be described below. FIG. 2 is a cross-sectional view of the latent image carrying body 10Y and the development unit 30Y, showing principal components thereof. FIG. 3 is a schematic perspective view of the developer supplying member and FIG. 4 is a schematic illustration of compression of developer by developer compressing device 22Y, while FIG. 5 is a schematic illustration of development by the developing roller 20Y and FIG. 6 is a schematic illustration of the squeezing effect of the squeezing roller 13Y. The latent image carrying bodies 10Y, 10M, 10C and 10K have a same configuration while the development units 30Y, 30M, 30C and 30K have a same configuration. Therefore, only the yellow (Y) latent image carrying body 10Y and the yellow (Y) development unit 30Y will be described below.

A cleaning unit including a charge eliminator 16Y, a latent image carrying body cleaning blade 17Y and a developer collecting section 18Y, an electric charger 11Y, an exposure unit 12Y, a developing roller 20Y of the development unit 30Y, a first squeezing device 13Y including a first squeezing roller 13*a*Y and first squeezing roller cleaning blade 13*b*Y and a second squeezing device 14Y including a second squeezing roller 14*a*Y and a second squeezing roller cleaning blade 14*b*Y are arranged around the outer periphery of the latent image carrying body 10Y in the mentioned order in the sense of rotation thereof. The development unit 30Y includes a developing roller cleaning blade 21Y, or a developer carrying body cleaning blade, and a developer supply roller 32Y formed by using an anilox roller, which are arranged around the developing roller 20Y, along with an agitation auger 36Y that is an agitation member and a developer supply roller 32Y, which are contained in the liquid developer container 31Y. A primary transfer roller 51Y of the primary transfer section is arranged along the intermediate transfer belt 40 at a position located opposite to the latent image carrying body 10Y.

The latent image carrying body 10Y is a photosensitive drum that is a cylindrical member showing a width greater than the width of the developing roller 20Y, which is equal to 320 mm, and having a photosensitive layer formed on the outer peripheral surface thereof. It is typically driven to rotate clockwise as shown in FIG. 2. The photosensitive layer of the latent image carrying body 10Y is an organic latent image carrying body or an amorphous silicon latent image carrying body. The electric charger 11Y is arranged upstream relative to the nip section between the latent image carrying body 10Y and the developing roller 20Y in the sense of rotation of the latent image carrying body 10Y. A bias voltage having a polarity same as the polarity of the electric charge of developing toner particles is applied to the electric charger 11Y from a power source (not shown) in order to electrically charge the latent image carrying body 10Y. The exposure unit 12Y exposes the latent image carrying body 10Y that is electrically charged by the electric charger 11Y to light at a position downstream relative to the electric charger 11Y in the sense of rotation of the latent image carrying body 10Y to form a latent image on the latent image carrying body 10Y.

The development unit 30Y includes a developing roller 20Y for carrying liquid developer, a developing roller cleaning blade 21Y for cleaning the developing roller 20Y, a developer compressing member 22Y for producing a compressed state to the developer on the developing roller 20Y, a combination of a developer supply roller 32Y and a developer limiting blade 33Y for agitating liquid developer to maintain it in a uniformly dispersed state and supplying it to the developing roller 20Y and a developer container 31Y for storing liquid developer in a state where toner is dispersed in carrier liquid to a weight ratio of about 25%. The developer container 31Y by turn includes a supplying section 31*a*Y and a collecting section 31*b*Y. The supplying section 31*a*Y has an agitation auger 36Y for agitating the developer in the developer container 31Y and a communicating section 35Y for supplying liquid developer from a liquid developer reservoir section 71Y, which will be described in greater detail hereinafter, to the agitation auger 36Y, while the collecting section 31*b*Y has a developing roller cleaning blade 21Y and a collecting auger 34Y for collecting the liquid developer scraped off by the first squeezing roller cleaning blade 13*b*Y and the second squeezing roller cleaning blade 14*b*Y and conveying it to the liquid developer reservoir section 71Y. The collecting auger 34Y has a helical blade so as to operate as a conveying member.

The liquid developer contained in the developer container 31Y is not conventional volatile liquid developer prepared by using commercially available Isopar (trademark: available from Exxon) as carrier liquid that shows a low concentration (about 1 to 2 wt %) and a low viscosity and is volatile at room temperature but nonvolatile liquid developer that shows a high concentration and a high viscosity and is not volatile at room temperature. More specifically, liquid developer to be used for the purpose of the present invention is a high viscosity (about 30 to 1,000 mPa·s) liquid developer prepared by dissolving a solid element produced by dispersing a coloring agent such as a pigment having an average particle size of 1 μm into thermoplastic resin in a liquid solvent such as an organic solvent, silicon oil, mineral oil or edible oil with a dispersant so as to show a toner solid concentration of about 25%.

As shown in FIG. 3, the developer supply roller 32Y is an anilox roller which is a cylindrical member having a surface made to show projections and recesses by forming fine helical grooves so as to be able to carry developer with ease and move it uniformly on the surface. It is typically driven to rotate counterclockwise as shown in FIG. 2. The dimensions of the grooves are such that the grooves are arranged at a pitch of about 130 μm with a depth of about 30 μm. Thus, liquid developer is supplied from the developer container 31Y to the developing roller 20Y. The agitation auger 36Y and the developer supply roller 32Y may be so arranged as to contact and slide on each other or alternatively as to be separated from each other.

The developer limiting blade 33Y that is a member contacting the developer supply roller 32Y is a metal blade or an elastic blade formed by covering a metal blade with an elastic member. The developer limiting blade 33Y includes a rubber section held in contact with the surface of the developer supply roller 32Y and made of urethane rubber, and a metal plate supporting the rubber section. The developer limiting blade 33Y limits and adjusts the liquid developer being carried and conveyed by the developer supply roller 32Y, which is typically an anilox roller, in terms of film thickness and quantity so as to adjust the quantity of the liquid developer to be supplied to the developing roller 20Y. The sense of rotation of the developer supply roller 32Y may not necessarily be that of the arrow shown in FIG. 2 and it may alternatively be the other way. If it is so, the developer limiting blade 33Y needs to be arranged at a position that corresponds to the sense of rotation of the developer supply roller 32Y.

The developing roller 20Y is a cylindrical member having a width of about 320 mm that is driven to rotate counterclockwise around its axis of rotation as shown in FIG. 2. The developing roller 20Y is formed by arranging an elastic layer of polyurethane rubber, silicon rubber, NBR or the like on the outer peripheral part of an inner core that is typically made of metal such as iron. The developing roller cleaning blade 21Y is made of rubber and held in contact with the surface of the developing roller 20Y. The developing roller cleaning blade 21Y is arranged downstream relative to the nip section where the developing roller 20Y contacts the latent image carrying body 10Y in the sense of rotation of the developing roller 20Y so as to scrape off and remove the liquid developer remaining on the developing roller 20Y.

The developer compressing device 22Y applies a corona discharge from a corona discharger. As shown in FIG. 4, the toner T uniformly dispersed in carrier liquid C is moved to the side of the developing roller 20Y and coagulated to produce a so-called compressed developer state T'.

The developer D carried by the developing roller 20Y and brought into a compressed developer state is then developed to produce a developed image that corresponds to the latent image on the latent image carrying body 10Y at the developing nip section where the developing roller 20Y contact the latent image carrying body 10Y as shown in FIG. 5 as a desired electric field is applied thereto. Then, the developer D remaining after the development is scraped off and removed by the developing roller cleaning blade 21Y and collected at the side of the developer collecting auger 34Y in the developer container 31Y. The carrier liquid and the toner that are collected in this way is not in a mixed color state.

Now, the squeezing device that operates as carrier liquid removing device will be described below. The squeezing device of this embodiment includes a first squeezing device 13 and a second squeezing device 14 and is arranged opposite to the latent image carrying body 10Y at the downstream side of the developing roller 20Y so as to be constantly held in contact with the latent image carrying body 10Y and collect the excessive developer remaining after the development of the toner image.

The first squeezing device 13 is formed by a first squeezing roller 13*a*Y, which is an elastic roller member and by turn formed by coating a first elastic body 13*a*-1Y and held in contact with the latent image carrying body 10Y so as to be driven to rotate as shown in FIG. 6 and a first squeezing roller cleaning blade 13*b*Y adapted to push and contact the first squeezing roller 13*a*Y so as to clean the surface thereof as shown in FIG. 2.

The second squeezing device 14 is formed by a second squeezing roller 14*a*Y, which is an elastic roller member and by turn formed by coating a second elastic body 14*a*-1Y and held in contact with the latent image carrying body 10Y so as to be driven to rotate just like the first squeezing device 13 shown in FIG. 6 and a second squeezing roller cleaning blade 14*b*Y adapted to push and contact the second squeezing roller 14*a*Y so as to clean the surface thereof as shown in FIG. 2.

The squeezing devices 13 and 14 have a function of collecting the excessive carrier liquid C and the unnecessary fog toner T" from the developed developer D on the latent image carrying body 10Y to raise the content ratio of toner particles in the developed visible image. The capacity of collecting the excessive carrier liquid C can be set to a desired level by way of the sense of rotation of the first squeezing roller 13*a*Y and that of the second squeezing roller 14*a*Y and the relative peripheral speed difference between the moving speed of the peripheral surfaces of the first squeezing roller 13*a*Y and the second squeezing roller 14*a*Y relative to the moving speed of the peripheral surface of the latent image carrying body 10Y. More specifically, the collecting capacity is raised when the first squeezing roller 13*a*Y and the second acquiring roller

14*a*Y are driven to rotate in the sense of rotation opposite the sense of rotation of the latent image carrying body 10Y or when the relative peripheral speed difference is raised. The two techniques may be combined to produce a synergetic effect.

The excessive carrier liquid C and the unnecessary fog toner T" collected by the first squeezing roller 13*a*Y and the second squeezing roller 14*a*Y are collected from the first squeezing roller 13*a*Y and the second squeezing roller 14*a*Y to the side of the developer collecting auger 34Y in the developer container 31Y due to the effect of the first squeezing roller cleaning blade 13*b*Y and that of the second squeezing roller cleaning blade 14*b*Y. Since the excessive carrier liquid C and the fog toner T" are collected from the dedicated and isolated latent image carrying body 10Y and hence no mixed color phenomenon arise at anywhere.

It may alternatively be so arranged that the liquid developer collected by the first squeezing roller 13*a*Y and the second squeezing roller 14*a*Y is dropped onto the developing roller cleaning blade 21Y and the liquid developer dropped onto the developing roller cleaning blade 21Y and the liquid developer produced by the cleaning operation of the developing roller cleaning blade 21Y are further dropped into the collecting section 31*b*Y.

The developer image developed on the latent image carrying body 10Y is then transferred onto the intermediate transfer belt 40 by the primary transfer roller 51Y of the primary transfer section 50Y. The latent image carrying body 10Y and the intermediate transfer belt 40 are arranged so as to move at the same speed to reduce the load of driving the latent image carrying body 10Y to rotate and driving the intermediate transfer belt 40 to move and suppress the effect of external turbulence of the latent image carrying body 10Y on the visible toner image.

The developer collecting/supplying device 70Y includes a liquid developer reservoir section 71Y that stores the collected liquid developer and supplies high concentration developer and carrier liquid respectively from the developer tank 74Y and from the carrier liquid tank 77Y and operates for concentration adjustment.

In this embodiment, liquid developer is collected from the developing unit 30Y and the latent image carrying body 10Y. The liquid developer collected to the side of the developer collecting auger 34Y of the developing unit 30Y is then collected to the liquid developer reservoir section 71Y by way of a developing unit collecting channel 72Y. On the other hand, the liquid developer collected from the latent image carrying body 10Y by the latent image carrying body cleaning blade device 15Y that includes a latent image carrying body cleaning blade 17Y and a developer collecting section 18Y is then collected by the liquid developer reservoir section 71Y by way of a latent image carrying body collecting channel 73Y.

High concentration developer is supplied from a developer tank 74Y to the liquid developer reservoir section 71Y by way of a developer supply channel 75Y and a developer pump 76Y. On the other hand, carrier liquid is supplied from a carrier liquid tank 77 to the liquid developer reservoir section 71Y by way of a carrier liquid supply channel 78Y and a carrier liquid pump 79Y. An arrangement for supplying developer and carrier liquid by opening and closing respective valves, utilizing gravity, may alternatively be used to replace the pumps.

The liquid developer stored in the liquid developer reservoir section 71Y is supplied to the developer container 31Y by way of a developer supply channel 81Y and a developer supply pump 82Y through the communicating section 35Y.

Now, the operation of an image forming apparatus according to the present invention will be described. As for the latent image carrying bodies 10Y, 10M, 10C and 10K and the developing units 30Y, 30M, 30C and 30K, only the yellow latent image carrying body 10Y and the yellow developing unit 30Y will be described representatively for the four latent image carrying bodies 10Y, 10M, 10C and 10K and their peripherals and the four developing units 30Y, 30M, 30C and 30K and their peripherals.

In the developer container 31Y, the toner particles in the liquid developer have a positive electric charge and the liquid developer is agitated by the agitation auger 36Y and pumped up from the developer container 31Y as the developer supply roller 32Y is driven to rotate.

The developer limiting blade 33Y is held in contact with the surface of the developer supply roller 32Y to scrape off the excessive liquid developer on the surface of the developer supply roller 32Y except the liquid developer left in the grooves of the anilox pattern formed on the surface of the developer supply roller 32Y showing projections and recesses so as to limit the quantity of liquid developer to be supplied to the developing roller 20Y. Due to the limiting effect, the quantity of liquid developer supplied to the developing roller 20Y is limited to make the film thickness of the liquid developer applied to the developing roller 20Y equal to about 6 μm. The liquid developer scraped off by the developer limiting blade 33Y is made to fall down into the developer container 31Y by gravity and the liquid developer that is not scraped off by the developer limiting blade 33Y is held in the grooves on the surface of the developer supply roller 32Y showing projections and recesses and subsequently applied to the surface of the developing roller 20Y as the developer supply roller 32Y is pressed against the developing roller 20Y.

The developing roller 20Y now carrying the liquid developer applied thereto by the developer supply roller 32Y is then brought into contact with the developer compressing device 22Y at a position downstream relative to the nip section between the developing roller 20Y and the developer supply roller 32Y. A bias voltage of about +400 V is applied to the developing roller 20Y, while a bias voltage higher than the bias voltage being applied to the developing roller 20Y and showing the polarity same as the polarity of the electric charge of the toner is applied to the developer compressing device 22Y. For example, a bias voltage of about +4 kV is applied to the developer compressing device 22Y.

The latent image carrying body 10Y is made of amorphous silicon and, after its surface is electrically charged to about +600 V by the electric charger 11Y at a position upstream relative to the nip section between the latent image carrying body 10Y and the developing roller 20Y, a latent image is formed thereon in such a way that the image part of the latent image carrying body 10Y is made to show an electric potential of +25 V by the exposure unit 12Y. At the developing nip section formed between the developing roller 20Y and the latent image carrying body 10Y, toner particles T are selectively driven to move to the image part on the latent image carrying body 10Y according to the electric field formed by the bias voltage of +400 V being applied to the developing roller 10Y and the latent image (image part: +25 V, non-image part +600 V) on the latent image carrying body 10Y so that, as a result, a toner image is formed on the latent image carrying body 10Y as illustrated in FIG. 5. On the other hand, since carrier liquid C is not influenced by the electric field, it is separated from the toner particles T at the exit of the developing nip section between the developing roller 20Y and the latent image carrying body 10Y and adheres to both the developing roller 20Y and the latent image carrying body 10Y as shown in FIG. 5.

After passing the developing nip section, the latent image carrying body 10Y passes the squeezing roller 13Y. As shown in FIG. 6, the squeezing roller 13Y has a function of collecting the excessive carrier liquid C and the unnecessary fog toner T" from the developed developer D on the latent image carrying body 10Y to raise the content ratio of toner particles in the developed visible image. The capacity of collecting the excessive carrier liquid C can be set to a desired level by way of the sense of rotation of the first squeezing roller 13*a*Y and that of the second squeezing roller 14*a*Y and the relative peripheral speed difference between the moving speed of the peripheral surfaces of the first squeezing roller 13*a*Y and the second squeezing roller 14*a*Y relative to the moving speed of the peripheral surface of the latent image carrying body 10Y. More specifically, the collecting capacity is raised when the first squeezing roller 13*a*Y and the second squeezing roller 14*a*Y are driven to rotate in the sense of rotation opposite the sense of rotation of the latent image carrying body 10Y or when the relative peripheral speed difference is raised. The two techniques may be combined to produce a synergetic effect.

In this embodiment, the first squeezing roller 13*a*Y and the second squeezing roller 14*a*Y are driven to rotate at a peripheral speed same as that of the latent image carrying body 10Y to collect the excessive carrier liquid C from the developer D developed on the latent image carrying body 10Y by 5 to 10 wt % so as to reduce the load of driving the two squeezing rollers to rotate and suppress the effect of external turbulence of the latent image carrying body 10Y on the visible toner image.

Subsequently, the latent image carrying body 10Y passes the nip section between itself and the intermediate transfer belt 40 at the primary transfer section 50Y to transfer the visible toner image to the intermediate transfer belt 40 for primary transfer. The toner on the latent image carrying body 10Y is transferred onto the intermediate transfer belt 40 for primary transfer and only the carrier liquid is left on the latent image carrying body 10Y as a bias voltage of about −200 V is applied to the primary transfer roller 51Y with the polarity opposite to the polarity of electric charge of the toner particles. After the primary transfer, the electrostatic charge of the latent image carrying body 10Y is eliminated by the charge eliminator 16Y that is formed by using LEDs and the carrier liquid left on the latent image carrying body 10Y is scraped off by the latent image carrying body cleaning blade 17Y and collected by the developer collecting section 18Y at a position downstream relative to the primary transfer section in the sense of rotation of the latent image carrying body 10Y.

The toner image on the intermediate transfer belt 40 so as to be carried by it by sequentially laying toner images formed on the plurality of latent image carrying bodies 10Y one on the other for primary transfer then proceeds to the secondary transfer unit 60 and gets into the nip section between the intermediate transfer belt 40 and the secondary transfer roller 61. The nip width is defined to be 3 mm. In the secondary transfer unit 60, voltages of −1,200 V and +200 V are applied respectively to the secondary transfer roller 61 and the belt drive roller 41 so that, as a result, the toner image on the intermediate transfer belt 40 is transferred onto a recording medium (sheet member).

However, if a trouble such as a jam occurs to the supply of a sheet member, all the toner image may not be transferred onto and collected by the secondary transfer roller but part thereof may be left on the intermediate transfer belt. Additionally, in the ordinary secondary transfer process, the toner image on the intermediate transfer belt may not be moved to a sheet member by 100% for secondary transfer but several % may be left on the intermediate transfer belt after the secondary transfer. Particularly, when a trouble such as a jam occurs to the supply of a sheet member, the intermediate transfer belt is brought into contact with the secondary transfer roller 61 without a sheet member interposed between them to give rise to a stain to the rear surface of the sheet member.

In this embodiment, the carrier liquid of the unnecessary toner image is collected (squeezed) at the side of the secondary transfer roller 61 and the surface of the intermediate transfer belt 40 is cleaned by the intermediate transfer belt cleaning blade 46 and the developer collecting section 47, while the secondary transfer roller 61 is cleaned by the secondary transfer roller cleaning blade 62.

Figure 7:
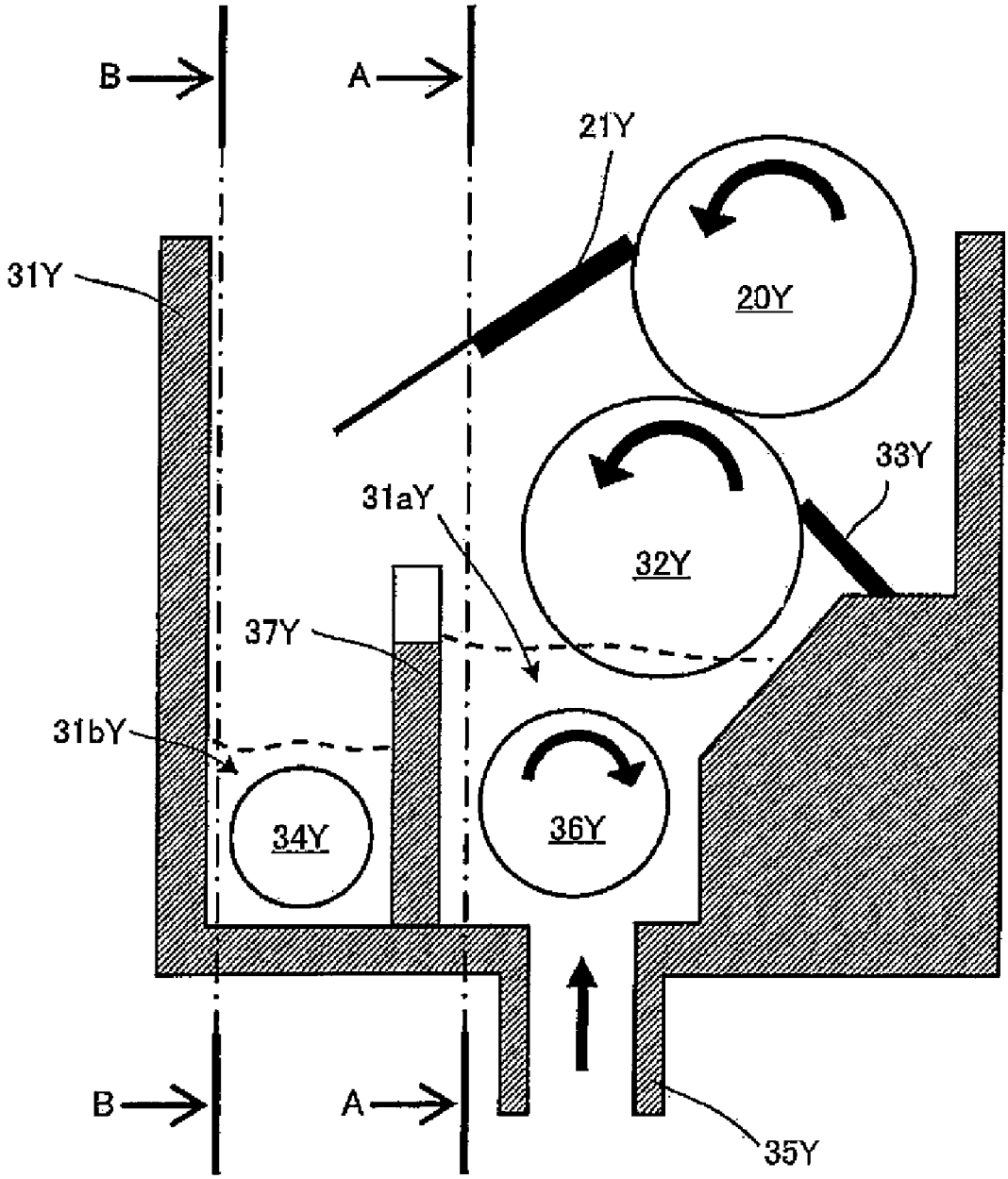
FIG. 7 is a schematic cross-sectional view of part of the development unit 30Y of the embodiment.
Figure 8:
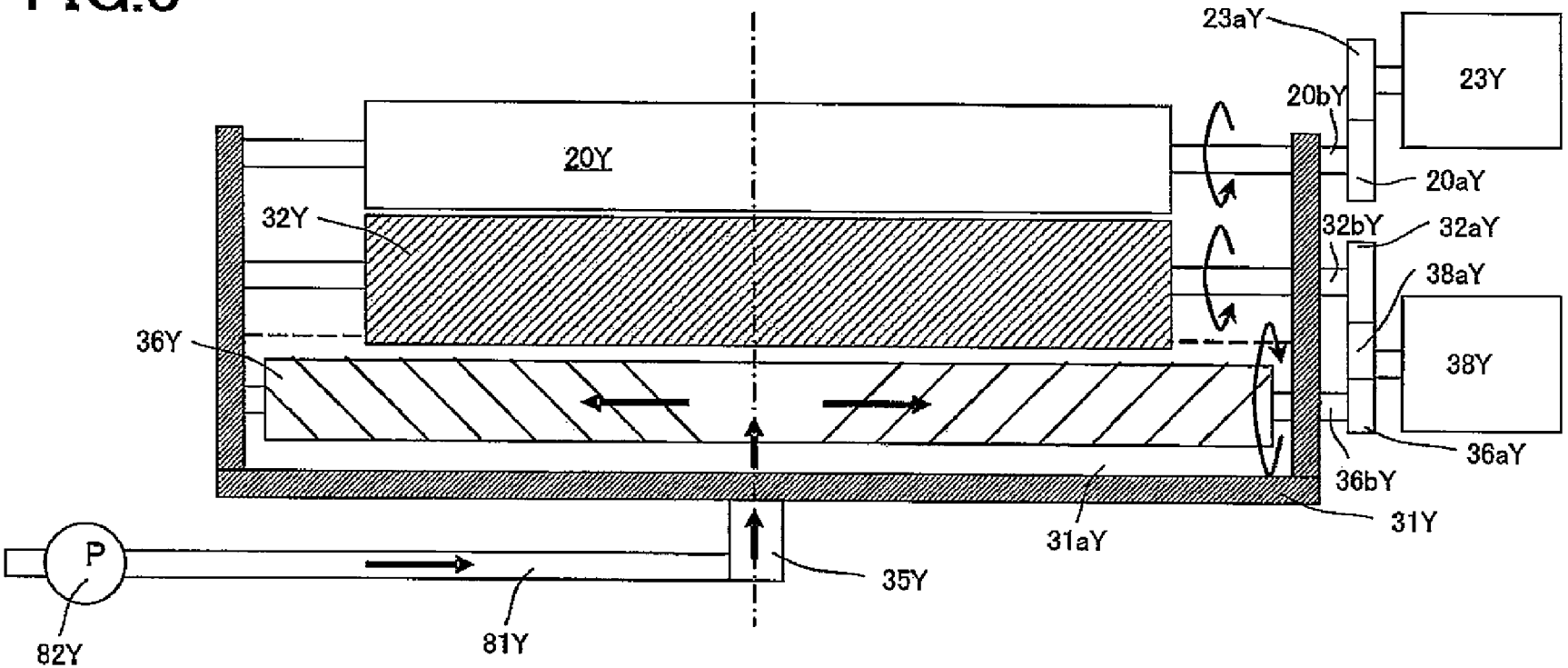
FIG. 8 is a schematic view taken along plane A-A in FIG. 7.

Now, the flow of liquid developer in the developer container 31Y of this embodiment will be described below. FIG. 7 is a schematic cross-sectional view of part of the development unit 30Y of the embodiment. FIG. 8 is a schematic view taken along plane A-A and viewed in the direction of the corresponding arrows in FIG. 7 and FIG. 9 is a schematic view taken along plane B-B and viewed in the direction of the corresponding arrows in FIG. 7.

As shown in FIG. 7, the developer container 31Y of this embodiment includes a supplying section 31*a*Y, a collecting section 31*b*Y and a liquid level adjusting plate 37Y that is a wall section disposed between the supplying section 31*a*Y and the collecting section 31*b*Y. The liquid level adjusting plate 37Y includes a first low wall section 37*a*Y and a second low wall section 37*b*Y arranged at the opposite ends and a high wall section 37*c*Y arranged at a central side, the first and second low wall sections 37*a*Y and 37*b*Y being lower than the high wall section 37*c*Y. However, it is sufficient for the liquid level adjusting plate 37Y to have at least a first low wall section 37*a*Y as a low wall section.

Liquid developer is pumped up by the developer supply pump 82Y from the liquid developer reservoir section 71Y shown in FIG. 2 and supplied to the supplying section 31*a*Y of the developer container 31Y by way of the developer supply channel 81Y and the communicating section 35Y. As shown in FIG. 8, the communicating section 35Y is arranged at a substantially central part in the axial direction and the liquid developer supplied to the supplying section 31*a*Y is spread from the substantially central part toward the opposite ends in the axial direction because the agitation auger 36Y has spiral blades extending from the axial central part toward the opposite ends in the opposite directions respectively.

Figure 9:
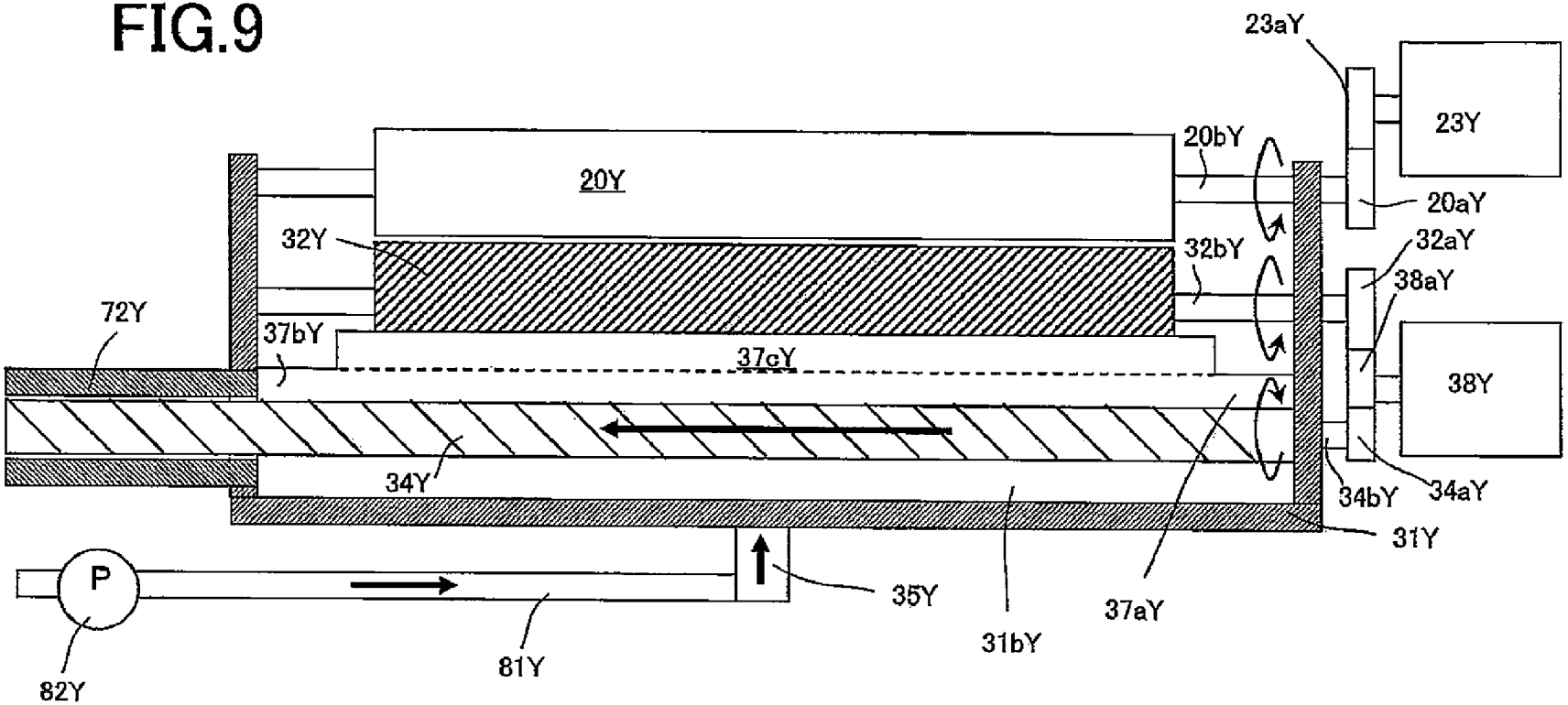
FIG. 9 is a schematic view taken along plane B-B in FIG. 7.

As the quantity of liquid developer in the supplying section 31*a*Y increases, liquid developer overflows into the collecting section 31*b*Y by way of the first low wall section 37*a*Y and the second low wall section 37*b*Y arranged at the opposite ends of the liquid level adjusting plane 37Y shown in FIG. 9. In the collecting section 31*b*Y, liquid developer is conveyed to the developing unit collecting channel 72Y and collected in the liquid developer reservoir section 71Y shown in FIG. 2 by way of the developing unit collecting channel 72Y as the collecting auger 34Y rotates.

As shown in FIGS. 8 and 9, the developing roller 20Y is driven to rotate with a combination of a developing roller gear 20*a*Y and a developing roller shaft 20*b*Y by a developing roller drive motor 23Y that is a developer carrying body drive source by way of a developing roller drive motor gear 23*a*Y. On the other hand, the developer supply roller 32Y, the agitation auger 36 and the collecting auger 34Y are driven to rotate by a developer supplying/collecting motor 38Y that is a common developer supplying/collecting section drive source by way of a developer supplying/collecting motor gear 38$a$Y respectively with a combination of a developer supply roller gear 32$a$Y and a developer supply roller shaft 32$b$Y, a combination of an agitation auger gear 36$a$Y and an agitation auger shaft 36$b$Y and a combination of a collecting auger gear 34$a$Y and a collecting auger shaft 34$b$Y.

Figure 10:
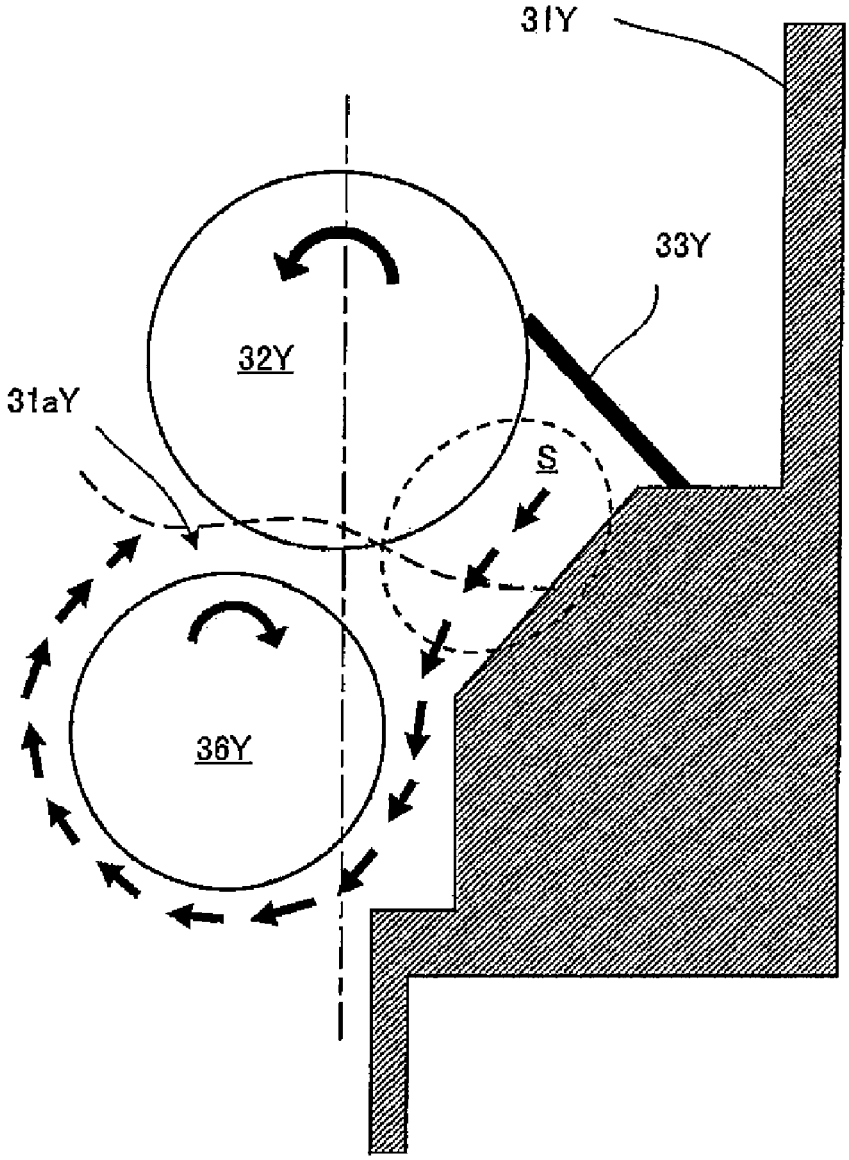
FIG. 10 is a schematic illustration of the moving direction of liquid developer in the supplying section 31*a*Y of the embodiment.

FIG. 10 is a schematic cross-sectional view of the inside of the supplying section 31$a$Y illustrating the moving direction of liquid developer in the supplying section 31$a$Y. According to the present invention, the limiting blade 33Y is arranged at one of the opposite sides of a perpendicular plane passing through the center of the shaft of the developer supply roller 32Y, while the agitation auger 36Y is arranged at the other side of the perpendicular plane passing through the center of the shaft of the developer supply roller 32Y and also below the developer supply roller 32Y. The sense of rotation of the developer supply roller 32 and that of the agitation auger 36Y are opposite relative to each other. For example, the developer supply roller 32Y is driven to rotate counterclockwise and the agitation auger 36 is driven to rotate clockwise in FIG. 10 in this embodiment.

As the sense of rotation of the developer supply roller 32Y and that of the agitation auger 36 are made opposite to each other, the liquid developer pumped up by the developer supply roller 32Y into the space below the limiting blade 33Y, the quantity of which is limited by the limiting blade 33Y, is forced to move in the direction of the arrows in FIG. 10 as it is drawn by the rotary motion of the agitation auger 36. Then, as a result, the risk that liquid developer accumulates in and near the space S below the limiting blade 33Y and between the developer supply roller 32Y and the limiting blade 33Y to raise the pressure to the limiting blade 33Y is reduced.

Thus, as described above, the developing unit 30Y of this embodiment includes a developing roller 20Y adapted to carry liquid developer, a developer supply roller 32Y having helical grooves and adapted to supply liquid developer to the developing roller 20Y, a developer limiting blade 33 held in contact with the developer supply roller 32Y and a developer container 31Y for storing liquid developer and the liquid developer container 31Y has a supplying section 31$a$Y for storing liquid developer to be supplied to the developing roller 20Y by the developer supply roller 32Y and an agitation auger 36Y for agitating the liquid developer in the supplying section 31$a$Y, the developer limiting blade 33Y being arranged at one of the opposite sides relative to a perpendicular plane passing through the center of the shaft of the developer supply roller 32Y, while the agitation auger 36Y being arranged at the other side of the perpendicular plane passing through the center of the shaft of the developer supply roller 32Y and also below the developer supply roller 32Y, the sense of rotation of the developer supply roller 32Y and that of the agitation auger 36Y being opposite relative to each other. Thus, the embodiment can stably supply liquid developer to the developing roller 20Y by the developer supply roller 32Y without adding one or more than one members and/or significantly altering the configuration.

Additionally, since the agitation auger 36Y has helical blades extending oppositely from the axial center toward the opposite ends, it can agitate liquid developer so as to make it pervade the entire space of the supplying section 31$a$Y.

Still additionally, since the embodiment has a developing roller cleaning blade 21Y for cleaning the surface of the developing roller 20Y to remove liquid developer and the developer container 31Y includes a collecting section 31$b$Y for collecting the liquid developer collected by the developing roller cleaning blade 21Y and a partition section 37Y arranged between the supplying section 31$a$Y and the collecting section 31$b$Y such that liquid developer can move over it, a situation where the quantity of liquid developer in the supplying section 31$a$Y becomes excessive is avoided.

Still additionally, liquid developer can be collected smoothly since the collecting section 31$b$Y has a developing unit collecting channel 72Y for collecting liquid developer that is arranged at the side of one of the opposite ends of the conveying member 34Y and the collecting auger 34Y conveys liquid developer toward the developing unit collecting channel 72Y.

Still additionally, since the image forming apparatus of this embodiment has a latent image carrying body 10Y on which a latent image is developed by the developing roller 20Y, an electric charger 11Y for electrically charging the latent image carrying body 10Y, an exposure unit 12Y for exposing the latent image carrying body 10Y to light, an intermediate transfer belt 40 onto which the image on the latent image carrying body 10Y is transferred and the developing unit 30Y, it is possible to provide an image forming apparatus that produces high quality images at low cost.

Still additionally, since the image forming apparatus of this embodiment has a squeezing device 13Y for collecting excessive liquid developer out of the liquid developer on the latent image carrying body 10Y and the liquid developer collected by the squeezing devices 13Y and 14Y is made to drop into the collecting section 31$b$Y, the liquid developer in the collecting section 31$b$Y can move with ease and the apparatus does not require any additional member to cause the liquid developer in the collecting section 31$b$Y to move with ease so that it is possible to downsize the apparatus and reduce the manufacturing cost.

Furthermore, since the liquid developer collected by the squeezing devices 13Y and 14Y is made to drop onto the developing roller cleaning blade 21Y and the liquid developer that drops onto the developing roller cleaning blade 21Y and the liquid developer removed from the developing roller 20Y by the developing roller cleaning blade 21Y as a result of cleaning the developing roller 20Y drops into the collecting section 31$b$Y, the liquid developer on the surface of the developing roller cleaning blade 21Y can move with ease and the apparatus does not require any additional member to cause the liquid developer on the surface of the developing roller cleaning blade 21Y to move with ease so that it is possible to downsize the apparatus and reduce the manufacturing cost.

In this embodiment, the one of the opposite sides is referred to as the first side and the other side is referred to as the second side.

Now, the developing unit 30Y will be described below. Since the developing units 30Y, 30M, 30C and 30K of the different colors have a same configuration, only the developing roller 30Y for yellow (Y) will be described below.

Figure 11:
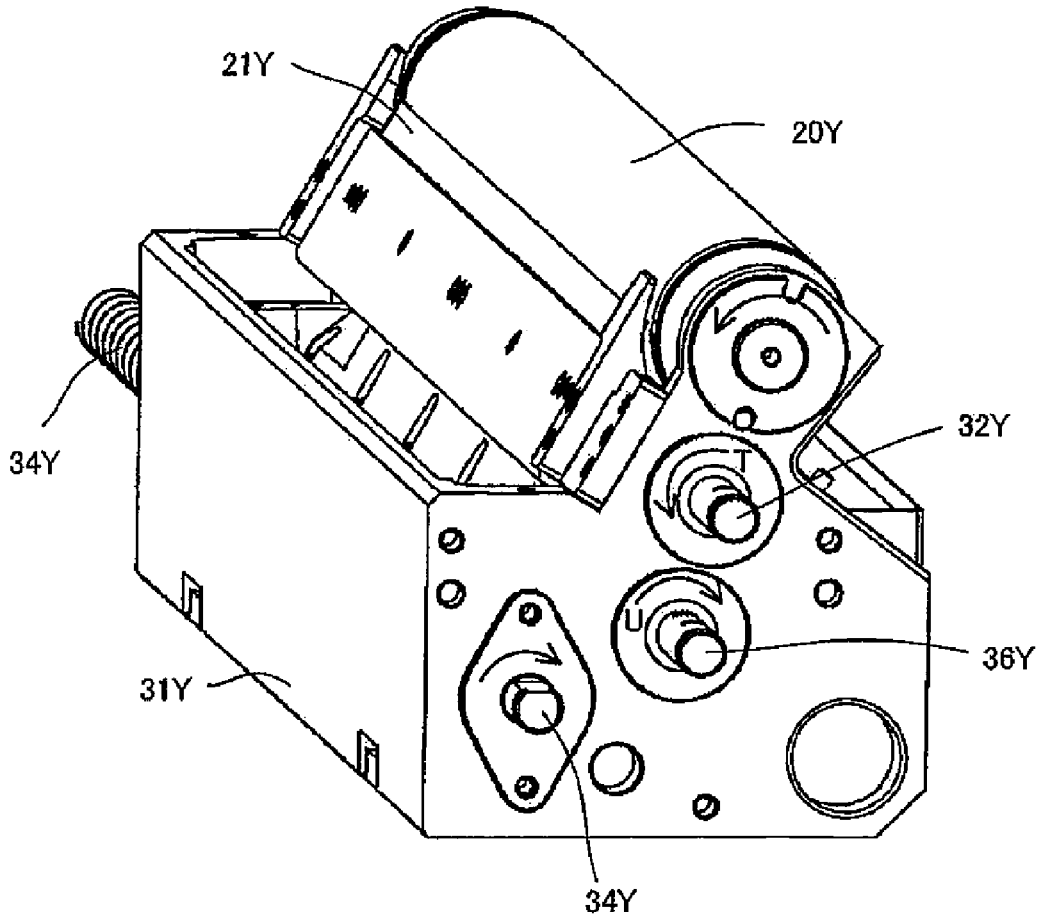
FIG. 11 is a schematic perspective view of the development unit 30Y of the embodiment.
Figure 12:
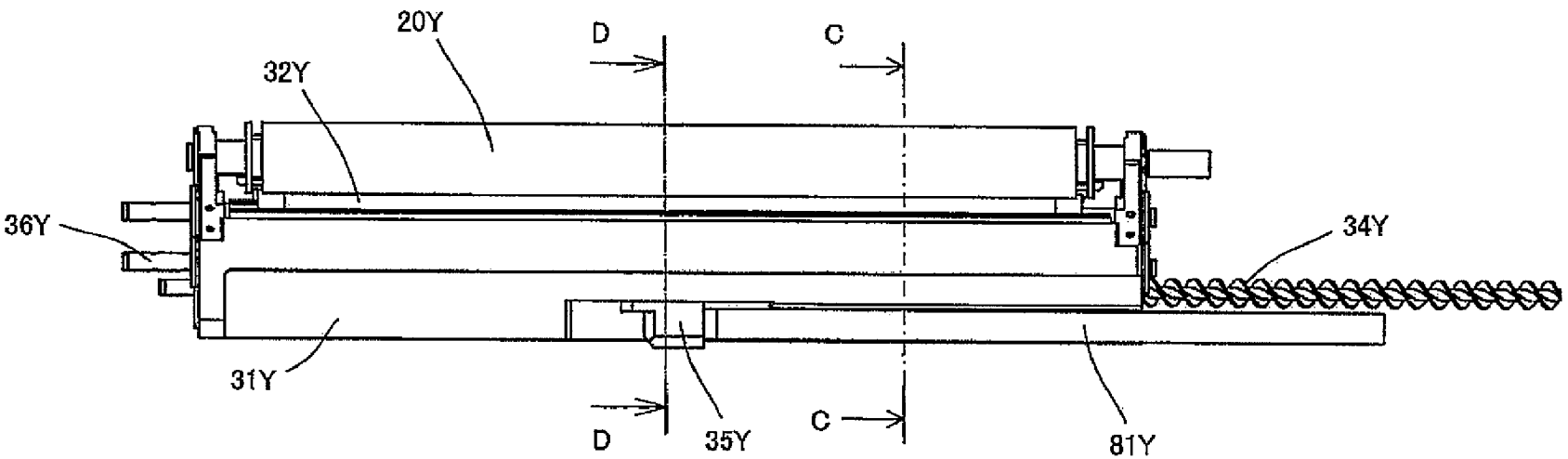
FIG. 12 is a schematic front view of the development unit 30Y of the embodiment.
Figure 13:
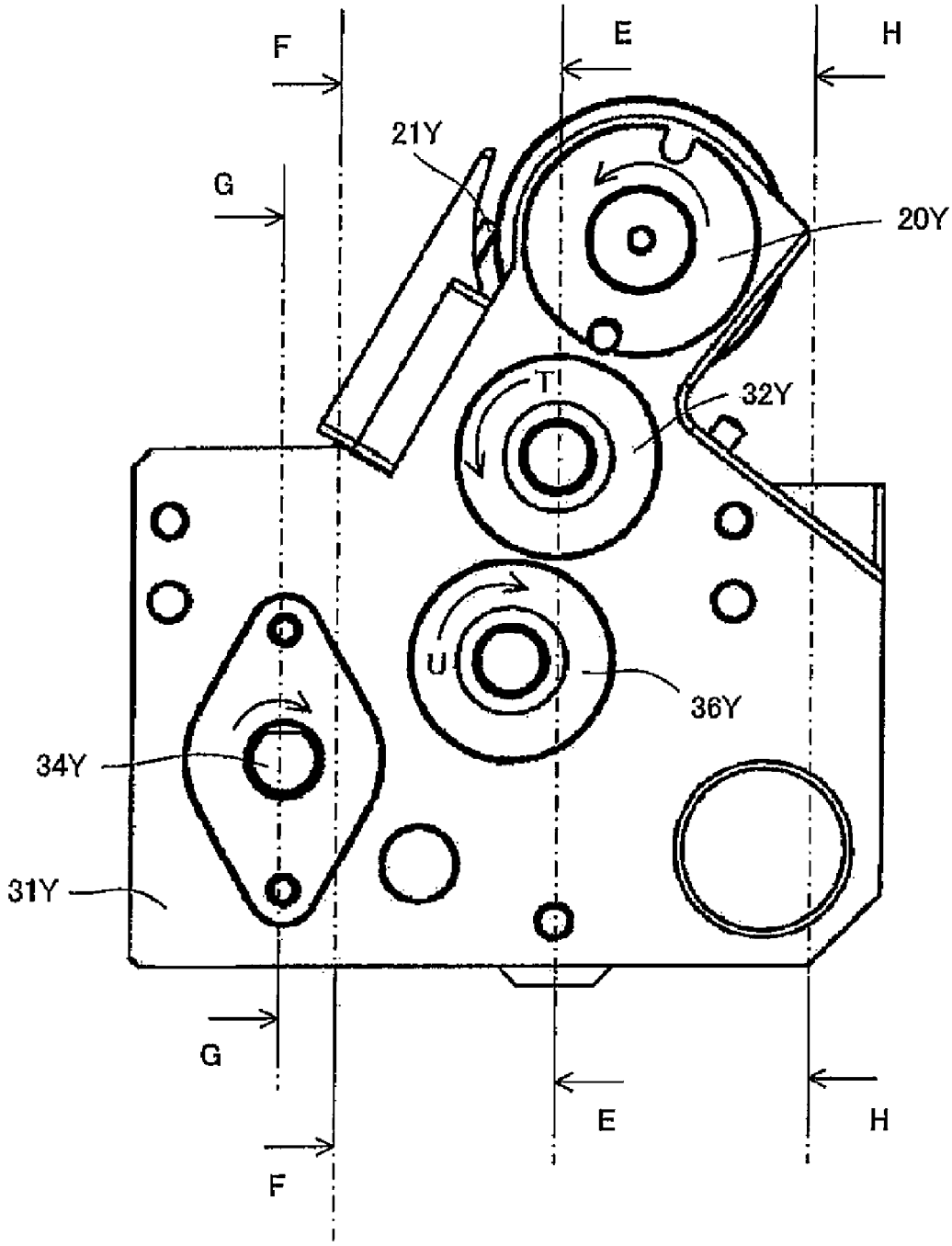
FIG. 13 is a schematic lateral view of the development unit 30Y of the embodiment.

FIG. 11 is a schematic perspective view of the development unit 30Y of this embodiment. FIG. 12 is a schematic front view of the development unit 30Y of this embodiment. FIG. 13 is a schematic lateral view of the development unit 30Y of this embodiment.

The developing unit 30Y has a developing roller 20Y for carrying liquid developer, a developing roller cleaning blade 21Y for cleaning the developing roller 20Y, a developer supply roller 32Y, a developer limiting blade 33Y, the developer supply roller 32Y and the developer limiting blade 33Y being adapted to agitate liquid developer so as to maintain it in a uniformly dispersed state and supply liquid developer to the developing roller 20Y and a developer container 31Y for storing liquid developer containing carrier liquid and toner.

Figure 14:
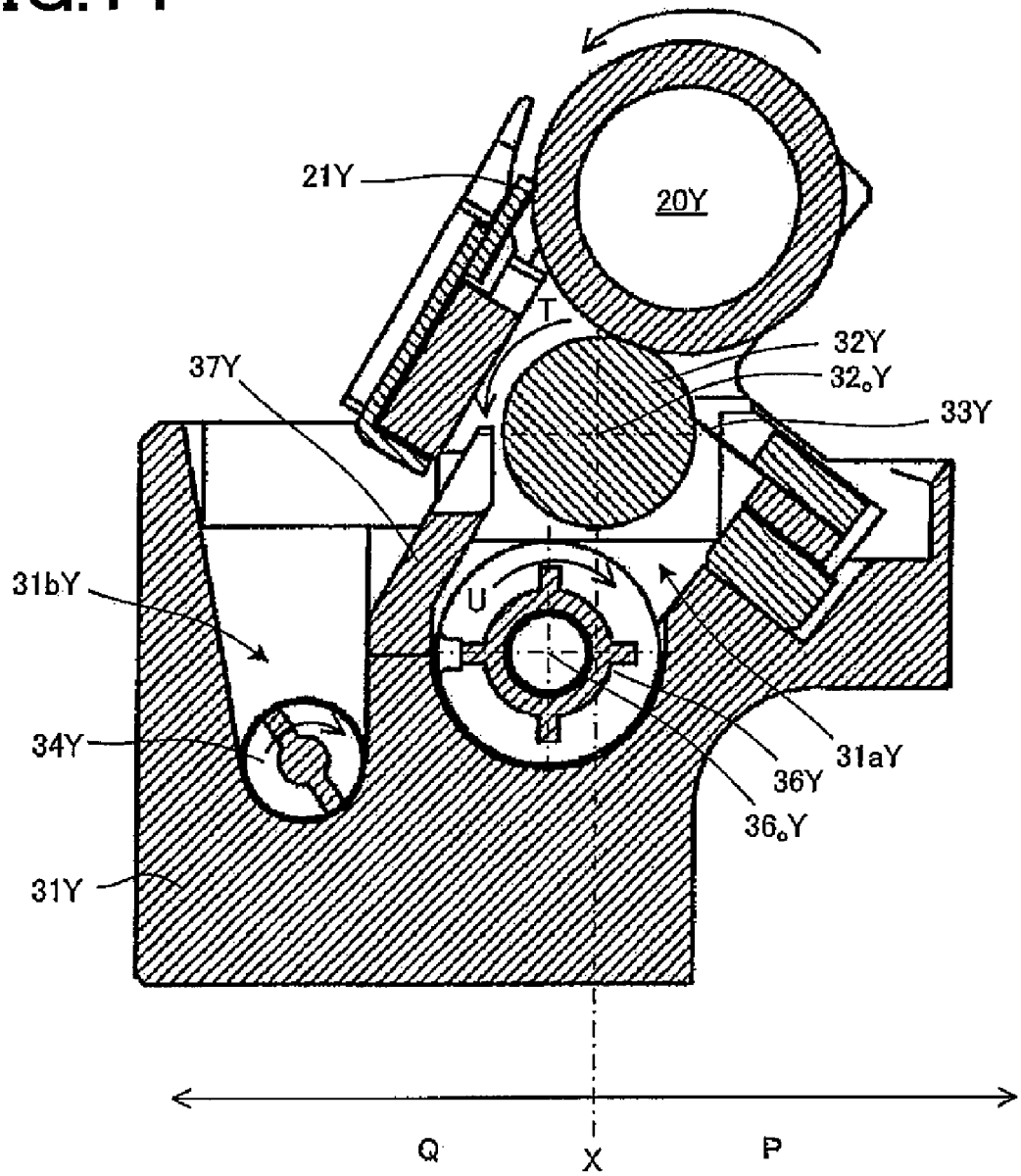
FIG. 14 is a schematic cross-sectional view of the development unit 30Y taken along C-C in FIG. 11.
Figure 15:
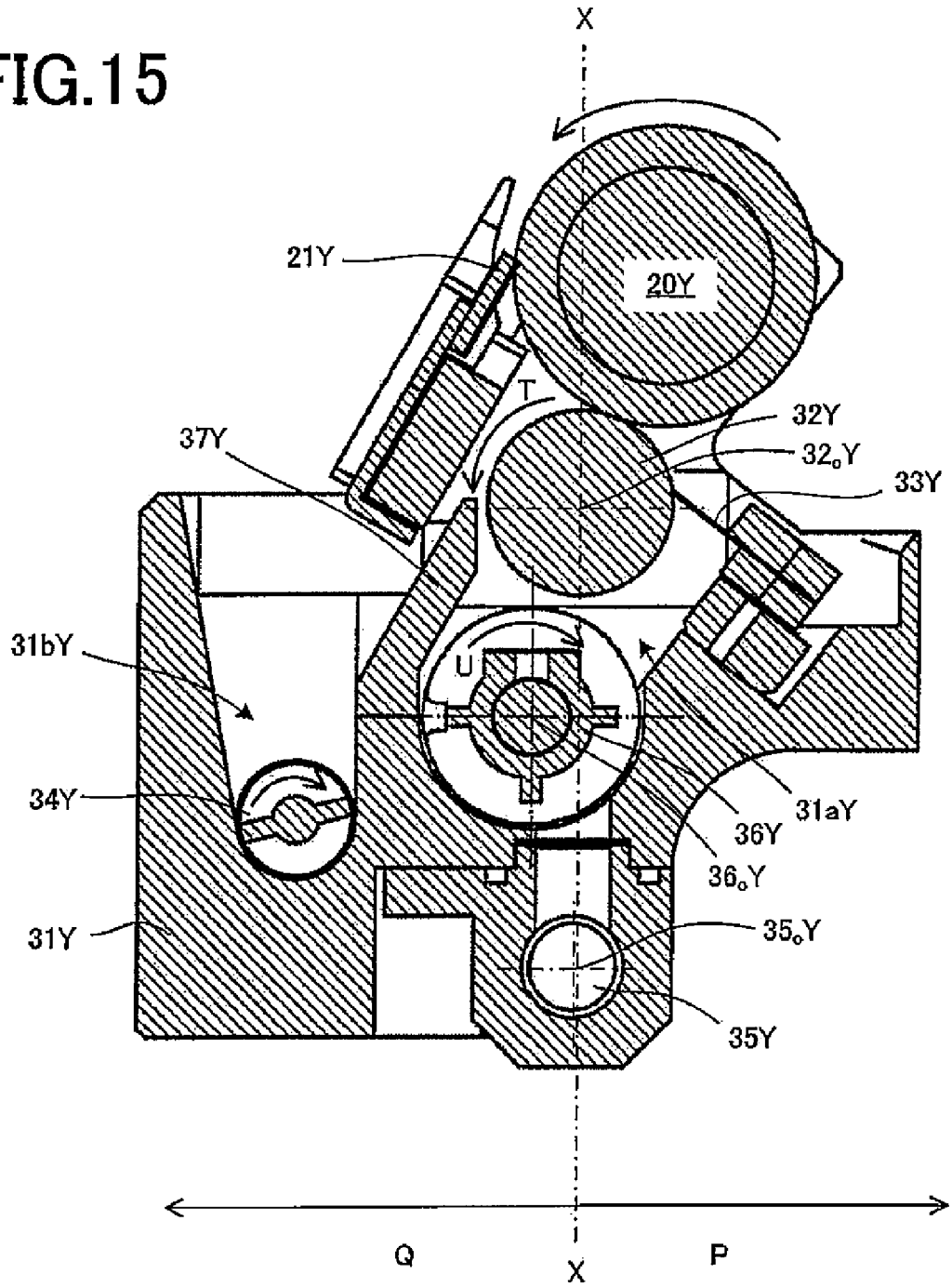
FIG. 15 is a schematic cross-sectional view of the development unit 30Y taken along D-D in FIG. 11.

FIG. 14 is a schematic cross-sectional view of the development unit 30Y taken along C-C in FIG. 11. FIG. 15 is a schematic cross-sectional view of the development unit 30Y taken along D-D in FIG. 11.

The developer container 31Y includes a supplying section 31*a*Y and a collecting section 31*b*Y, of which the supplying section 31*a*Y has an agitation auger 36Y for agitating the developer in the developer container 31Y and a communicating section 35Y for supplying liquid developer to the agitation auger 36Y and the collecting section 31*b*Y has a collecting auger 34Y having a helical blade for collecting the liquid developer scraped off by the developing roller cleaning blade 21Y and conveying it to the liquid developer reservoir section 71Y.

Liquid developer is pumped up from the developer container 31Y as the liquid developer in the developer container 31Y is agitated by the agitation auger 36Y and the developer supply roller 32Y is driven to rotate.

The developer limiting blade 33Y is held in contact with the surface of the developer supply roller 32Y so as to leave liquid developer only in the grooves of the anilox pattern formed on the surface of the developer supply roller 32Y showing projections and recesses and scrape off all the other liquid developer that is the excessive developer to limit the quantity of liquid developer to be supplied to the developing roller 20Y. The liquid developer scraped off by the developer limiting blade 33Y is made to fall back into the developer container 31Y by gravity, while the liquid developer that is not scraped off by the limiting blade 33Y is contained in the grooves on the surface of the developer supply roller 32Y showing projections and recesses and pressed against the developing roller 20Y so as to be applied to the surface of the developing roller 20Y.

The developer limiting blade 33Y is arranged at the first side P relative to a perpendicular plane X that passes through the center of the shaft $\mathbf{32}_o$Y of the developer supply roller 32Y, while the center of the shaft $\mathbf{36}_o$Y of the agitation auger 36Y is arranged at the second side Q relative to the perpendicular plane X that passes through the center of the shaft $\mathbf{32}_o$Y of the developer supply roller 32Y and below the developer supply roller 32Y. The sense of rotation T of the developer supply roller 32Y, or the first sense of rotation, and the sense of rotation U of the agitation auger 36Y, or the second sense of rotation, are opposite to each other and the developer supply roller 32Y is driven to rotate counterclockwise in the first sense of rotation T whereas the agitation auger 36 is driven to rotate clockwise in the second sense of rotation U.

Figure 16:
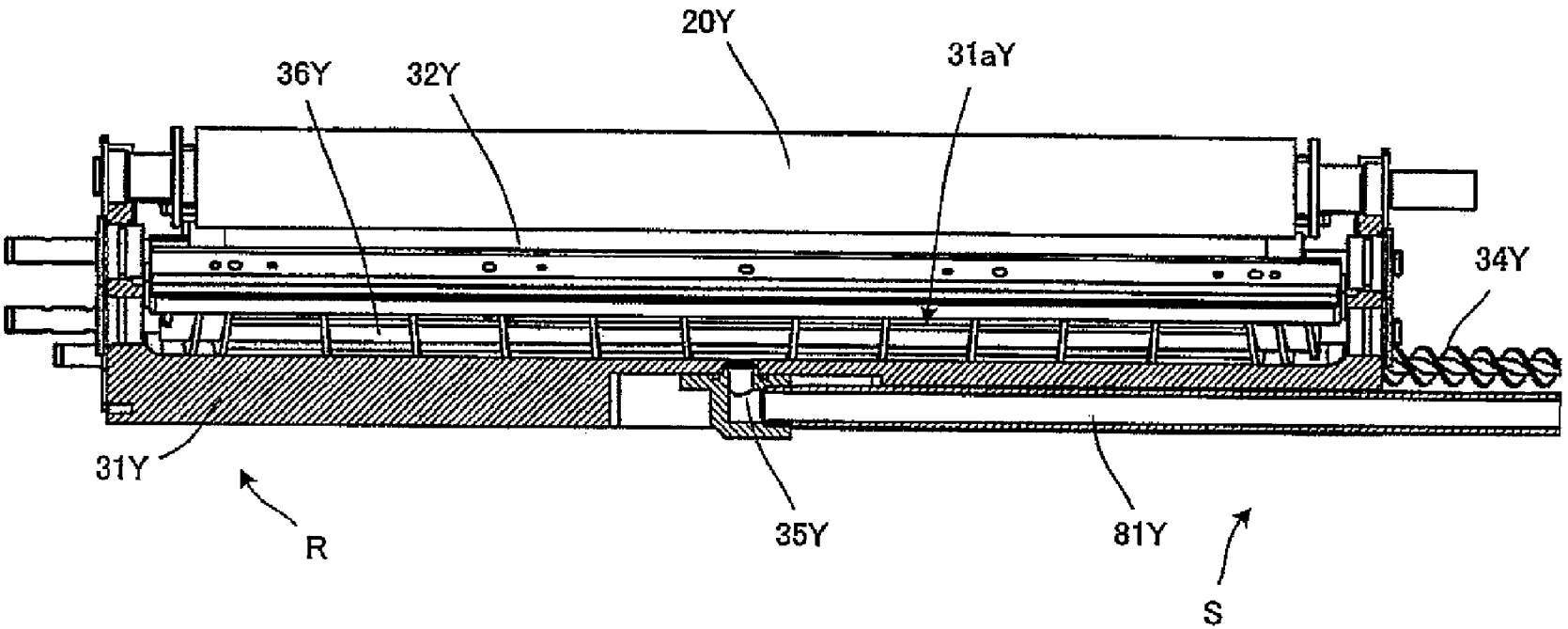
FIG. 16 is a schematic cross-sectional view of the development unit 30Y taken along E-E in FIG. 13.

Now, the flow of liquid developer in the developer container 31Y of this embodiment will be described below. FIG. 16 is a schematic cross-sectional view of the development unit 30Y taken along E-E in FIG. 13.

As shown in FIG. 16, liquid developer is pumped up from the liquid developer reservoir section 71Y shown in FIG. 2 by the developer supply pump 82Y and moved through the developer supply channel 81Y from the second end S toward the first end R so as to be supplied to the supplying section 31*a*Y of the developer container 31Y by way of the communicating section 35Y at a central part. The communicating section 35Y is arranged substantially at a central part in the axial direction.

Figure 17:
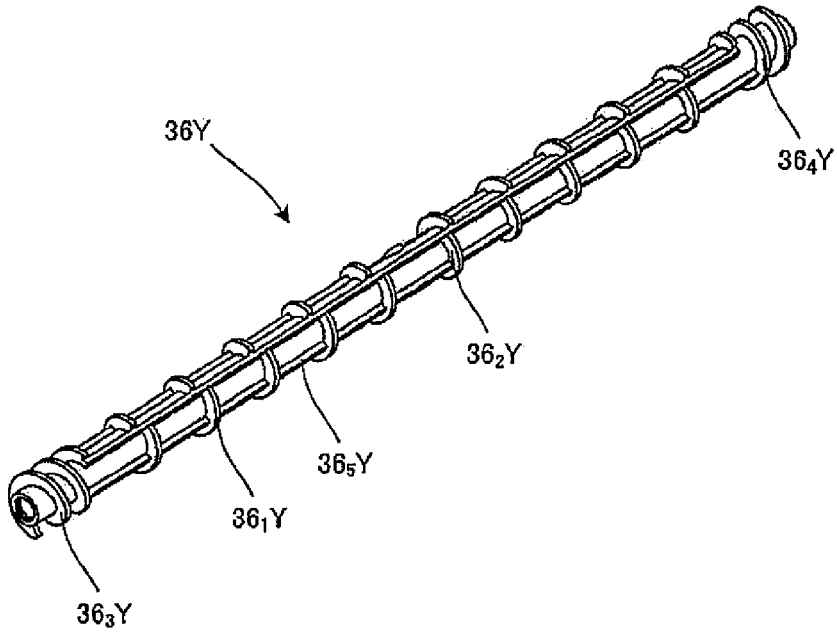
FIG. 17 is a schematic perspective view of the agitation auger 36Y of the embodiment.
Figure 18:
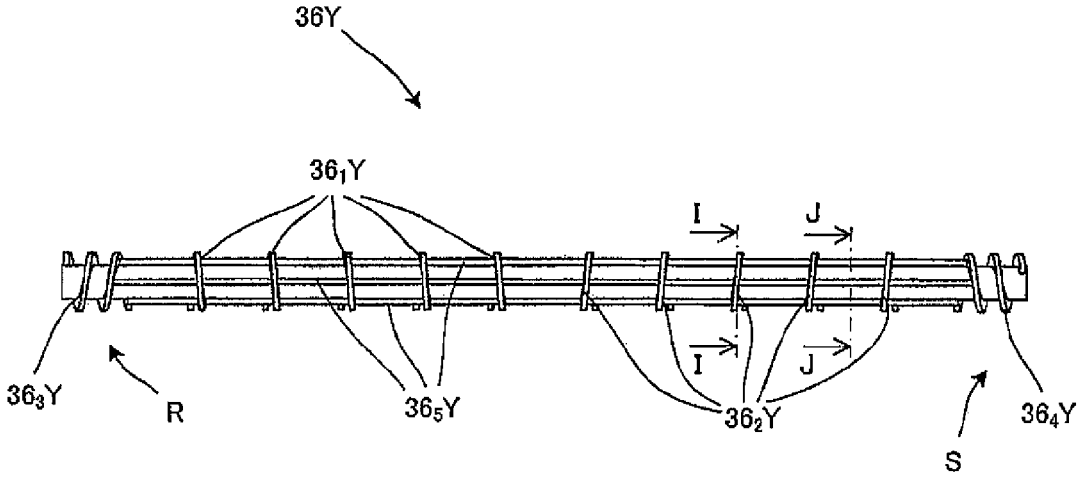
FIG. 18 is a schematic front view of the agitation auger 36Y of the embodiment.
Figure 19:
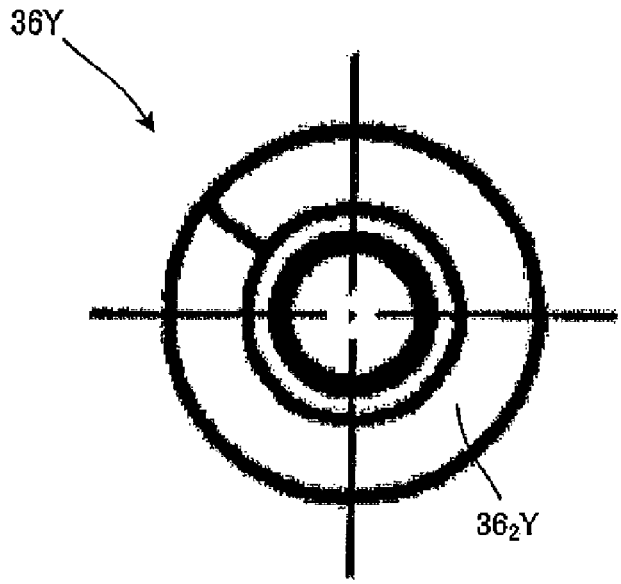
FIG. 19 is a schematic cross-sectional view of the agitation auger 36Y taken along I-I in FIG. 18.
Figure 20:
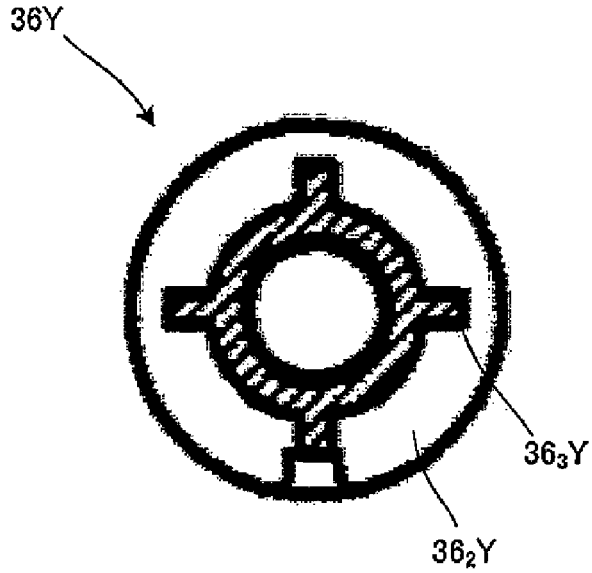
FIG. 20 is a schematic cross-sectional view of the agitation auger 36Y taken along J-J in FIG. 18.

FIG. 17 is a schematic perspective view of the agitation auger 36Y of the embodiment. FIG. 18 is a schematic front view of the agitation auger 36Y. FIG. 19 is a schematic cross-sectional view of the agitation auger 36Y taken along I-I in FIG. 18. FIG. 20 is a schematic cross-sectional view of the agitation auger 36Y taken along J-J in FIG. 18.

The agitation auger 36Y has helical blades extending oppositely from the axial center toward the opposite ends including a first helical blade $\mathbf{36}_1$Y extending toward the first end R and a second helical blade $\mathbf{36}_2$Y extending toward the second end S in FIG. 18. The agitation auger 36Y additionally has at the opposite ends thereof respectively a third blade $\mathbf{36}_3$Y extending toward the second end S oppositely relative to the first blade $\mathbf{36}_1$Y extending toward the first end R and a fourth blade $\mathbf{36}_4$Y extending toward the first end R oppositely relative to the second blade $\mathbf{36}_2$Y extending toward the second end S. The agitation auger 36Y still additionally has a rib $\mathbf{36}_5$Y extending in the axial direction of the agitation auger 36Y.

The liquid developer supplied to the supplying section 31*a*Y is spread from a substantially central part toward the opposite ends of the agitation auger 36Y in the axial direction as the agitation auger 36 is driven to rotate because the agitation auger 36Y has the first helical blade $\mathbf{36}_1$Y and the second helical blade $\mathbf{36}_2$Y extending from the central part toward the opposite ends in the axial direction. Thereafter, the liquid developer tends to flow toward the central part in the axial direction at the opposite ends by the third blade $\mathbf{36}_3$Y and the fourth blade $\mathbf{36}_4$Y. Additionally, the liquid developer is agitated by the rotation of the agitation auger 36Y and also forced to flow in the direction of arrows in FIG. 10Y by the rib $\mathbf{36}_5$Y.

Figure 21:
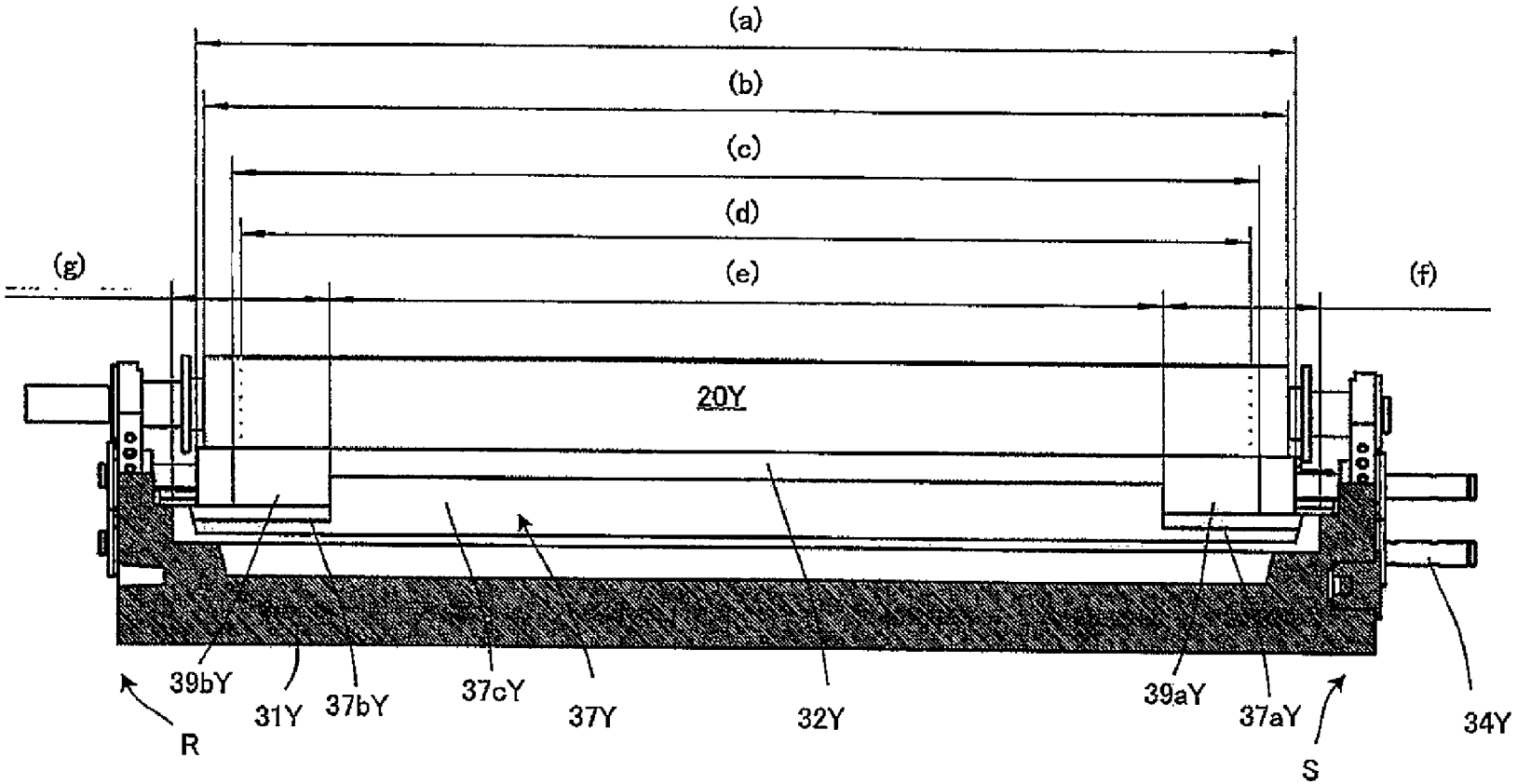
FIG. 21 is a schematic cross-sectional view of the development unit 30Y taken along F-F in FIG. 13.

FIG. 21 is a schematic cross-sectional view of the development unit 30Y taken along F-F in FIG. 13.

The developer container 31Y of this embodiment has a supplying section 31*a*Y, a collecting section 31*b*Y and a liquid level adjusting plate 37Y that is a wall between the supplying section 31*a*Y and the collecting section 31*b*Y. The liquid level adjusting plate 37Y includes a first low wall section 37*a*Y arranged at the first end R that is lower than a central part of the liquid level adjusting plate 37Y, a second low wall section 37*b*Y arranged at the second end S that is also lower than a central part of the liquid level adjusting plate 37Y and a high wall section 37*c*Y arranged at a central part that is higher than the first low wall section 37*a*Y and the second low wall section 37*b*Y. It also has a first moving section 39*a*Y and a second moving section 39*b*Y that correspond respectively to the first low wall section 37*a*Y and the second low wall section 37*b*Y. Note that it is sufficient for the liquid level adjusting plate 37Y to have at least the first low wall section 37*a*Y.

In FIG. 21, (a) and (b) respectively indicate the width of the developer supply roller and the width of the developing roller and (c) and (d) respectively indicate the width of supply section of the developer supply roller and the width of the image part, while (e) indicates the width of the high wall section of the liquid level adjusting plate and (f) and (g) respectively indicate the width of the first low wall section and that of the second low wall section. They have the relationship shown below.

$$(e)<(d)<(c)<(b)<(a)<(e)+(f)+(g) \quad (1)$$

In this embodiment, they may have exemplary specific values of (a) 371 mm, (b) 366 mm, (c) 347 mm, (d) 323 mm, (e) 281 mm, (f) 54 mm and (g) 54 mm.

When the quantity of liquid developer in the supplying section 31*a*Y increases, liquid developer overflows into the collecting section 31*b*Y by way of the first low wall section 37*a*Y and the second low wall section 37*b*Y arranged at the opposite ends of the liquid level adjusting plate 37Y as shown in FIG. 21.

Figure 22:
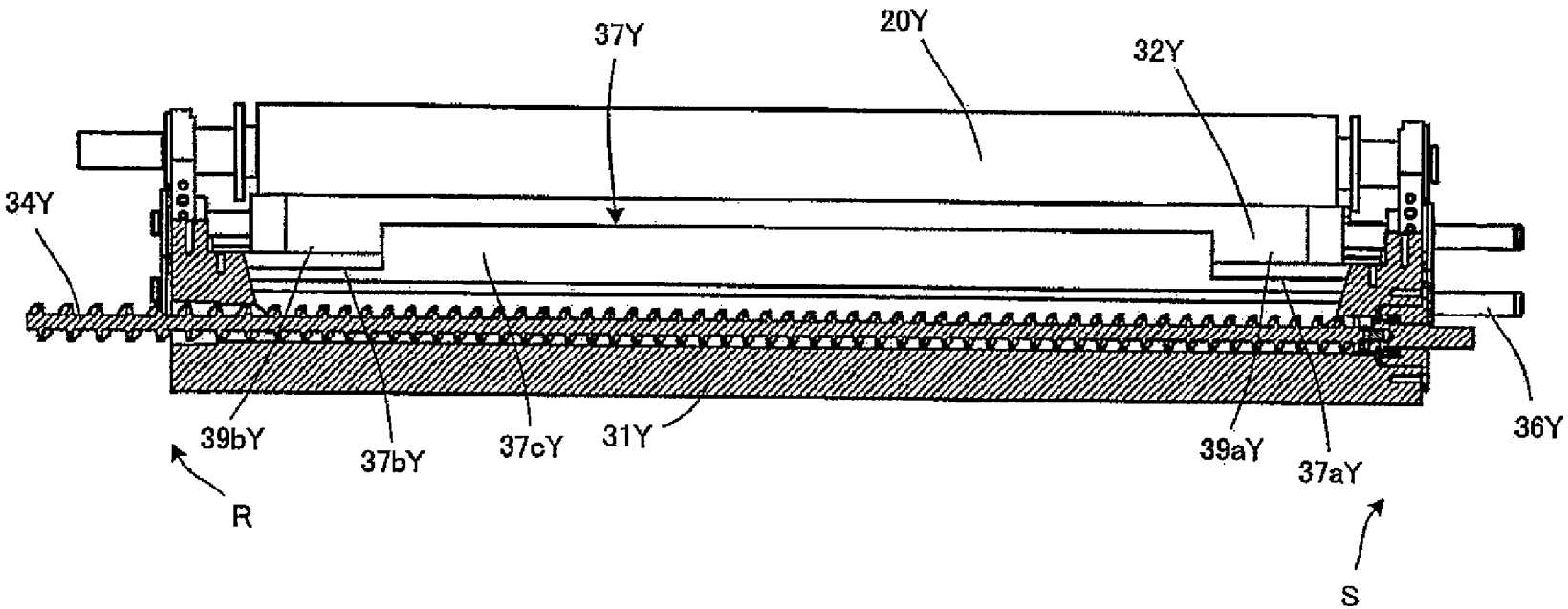
FIG. 22 is a schematic cross-sectional view of the development unit 30Y taken along G-G in FIG. 13.

FIG. 22 is a schematic cross-sectional view of the development unit 30Y taken along G-G in FIG. 13. The collecting section 31*b*Y has a collecting auger 34Y having a helical blade for collecting liquid developer and conveying it to the liquid developer reservoir section 71Y shown in FIG. 2 so as to operate as a conveying member. In the collecting section 31*b*Y, liquid developer is conveyed to the developing unit collecting channel 72Y shown in FIG. 2 due to the rotary motion of the collecting auger 34Y and collected in the liquid developer reservoir section 71Y by way of the developing unit collecting channel 72Y.

Figure 23:
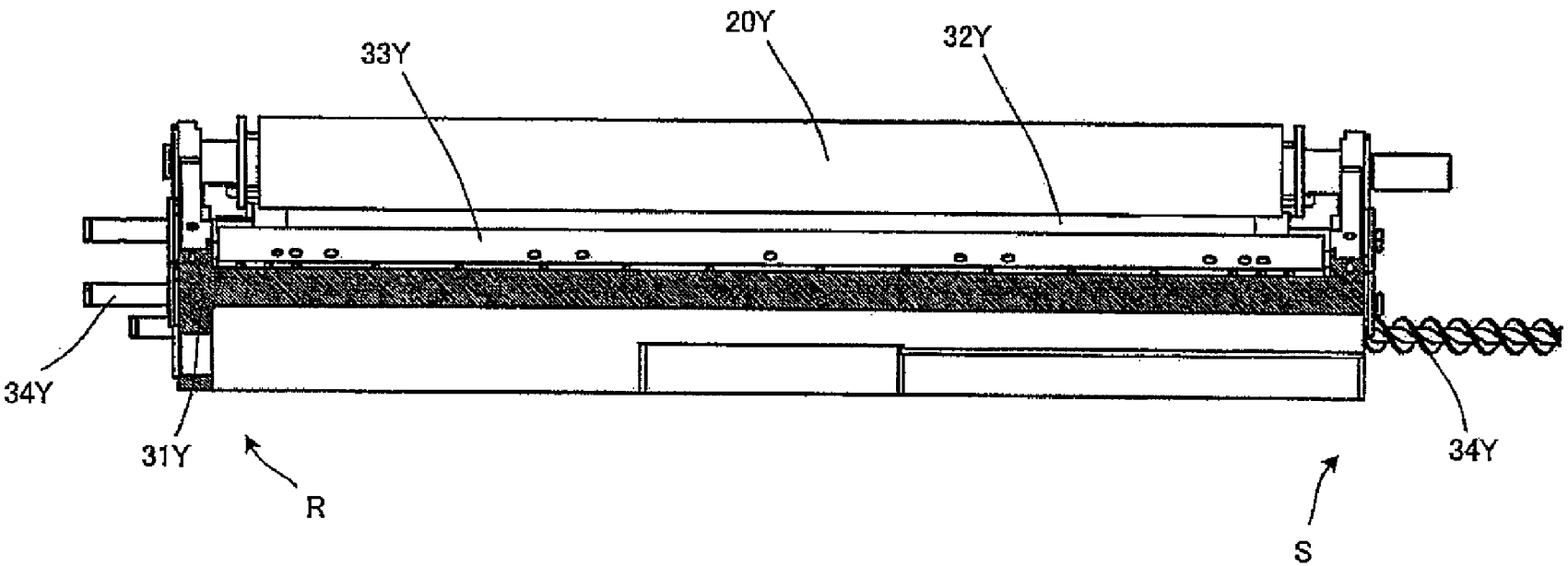
FIG. 23 is a schematic cross-sectional view of the development unit 30Y taken along H-H in FIG. 13.

FIG. 23 is a schematic cross-sectional view of the development unit 30Y taken along H-H in FIG. 13. The developer limiting blade 33Y is formed so as to be longer than the developer supply roller 32Y in the axial direction. In other words, it has a length that is sufficient for preventing the liquid developer scraped off from the developer supply roller 32Y from leaking from the developer limiting blade 33Y.

The partition section 37Y of this embodiment of the present invention operates as wall section. The developing roller 20Y, the developer supply roller 32Y, the developer limiting blade 33Y, the supplying section 31*a*Y, and the agitation member 34Y form a developing section.

In the developing device of this embodiment, the developer supply member 32Y can stably supply liquid developer to the developer carrying body 20Y without requiring any additional member and remarkable alteration to the arrangement.

Additionally, the developing device of this embodiment can agitate liquid developer so as to make it pervade the inside of the supplying section 31*a*Y.

Still additionally, the developing device of this embodiment can suppress any excessive quantity of liquid developer in the supplying section 31*a*Y.

Still additionally, the developing device of this embodiment can smoothly collect liquid developer.

Still additionally, the image forming apparatus of this embodiment can form high quality images and can be provided at low cost.

Still additionally, in the image forming apparatus of this embodiment, the liquid developer in the collecting section 31*b*Y is made to flow with ease without requiring any additional member so that the image forming apparatus can be downsized and manufactured at low cost.

Furthermore, in the image forming apparatus of this embodiment, the liquid developer on the surface of the developer carrying body cleaning member 21Y is made to flow with ease without requiring any additional member so that the image forming apparatus can be downsized and manufactured at low cost.

What is claimed is:

1. A developing device comprising:

a developer carrying body that carries liquid developer containing toner and carrier liquid;

a developer supplying member adapted to rotate in a first direction of rotation to supply liquid developer to the developer carrying body;

a contact member arranged at a first side relative to a virtual perpendicular plane passing through the axis of the developer supplying member so as to contact the developer supplying member;

a supply section that stores liquid developer to be supplied by the developer supplying member to the developer carrying body;

an agitating member that allows the liquid developer to flow from an axial center to the axial end section of the developer supplying member by rotating in a second direction of rotation different from the first direction of rotation and arranged at a second side relative to the virtual perpendicular plane passing through the axis of the developer supplying member;

a developer carrying body cleaning member for cleaning the developer carrying body and that is arranged at the second side;

a collecting section for collecting the liquid developer collected by the developer carrying body cleaning member and that is arranged at the second side; and a wall section that partitions the supply section from the collecting section, adjusts a liquid level of liquid developer stored in the supply section, allows the liquid developer stored in the supply section to flow from the supply section to the collecting section, and includes a high wall section having a first height in a perpendicular plane, and a low wall section having a second height lower than the first height arranged at an axial end section of the developer supplying member.

2. The developing device according to claim 1, wherein the agitating member has:

a first helical blade arranged to extend from a central part to a first end of the agitating member; and a second helical blade arranged to extend from the central part to a second end of the agitating member.

3. The developing device according to claim 2, wherein the agitating member has:

a third helical blade arranged at the first end; and a fourth helical blade arranged at the second end.

4. The developing device according to claim 1, wherein the agitating member has a rib arranged in the axial direction.

5. The developing device according to claim 1, wherein the collecting section has:

a conveying member that conveys the liquid developer collected by the developer carrying body cleaning member; and a developing device collecting channel connected to an end of the conveying member of the collecting section.

6. The developing device according to claim 1, wherein low wall sections are arranged on both end sections in an axial direction of the developer supplying member.

7. The developing device according to claim 1, wherein a width in an axial direction of the high wall section is less than a width of the developer supplying member.

8. An image forming apparatus comprising:

a developing section having:

a developer carrying body that carries liquid developer containing toner and carrier liquid;

a developer supplying member adapted to rotate in a first direction of rotation to supply liquid developer to the developer carrying body;

a contact member arranged at a first side relative to a virtual perpendicular plane passing through the axis of rotation of the developer supplying member so as to contact the developer supplying member;

a supply section that stores liquid developer to be supplied by the developer supplying member to the developer carrying body; and an agitating member that allows the liquid developer to flow from an axial center to the axial end section of the developer supplying member by rotating in a second direction of rotation different from the first direction of rotation and arranged at a second side relative to the virtual perpendicular plane passing through the axis of rotation of the developer supplying member;

a developer carrying body cleaning member for cleaning the developer carrying body and that is arranged at the second side;

a collecting section for collecting the liquid developer collected by the developer carrying body cleaning member and that is arranged at the second side;

a wall section that partitions the supply section from the collecting section, adjusts a liquid level of liquid developer stored in the supply section, allows the liquid stored in the supply section to flow from the supply section to the collecting section, and includes a high wall section having a first height in a perpendicular plane, and a low wall section having a second height lower than the first height arranged at an axial end section of the developer supplying member;

an exposure section that forms a latent image;

a latent image carrying body that develops the latent image formed by the exposure section by means of the developer carrying body; and a transfer member that receives the image developed by the latent image carrying body and transferred thereto.

9. The image forming apparatus according to claim 8, wherein the agitating member has:

a first helical blade arranged to extend from a central part to a first end of the agitating member; and a second helical blade arranged to extend from the central part to a second end of the agitating member.

10. The image forming apparatus according to claim 9, wherein the agitating member has:

a third helical blade arranged at the first end; and a fourth helical blade arranged at the second end.

11. The image forming apparatus according to claim 8, wherein the agitating member has a rib arranged in the axial direction.

12. The image forming apparatus according to claim 8, wherein the collecting section has:

a conveying member that conveys the liquid developer collected by the developer carrying body cleaning member; and a developing device collecting channel connected to an end of the conveying member of the collecting section.

13. The image forming apparatus according to claim 8, further comprising:

a squeezing member held in contact with the latent image carrying body where the latent image is developed by the developing section to squeeze off the image.

14. The image forming apparatus according to claim 8, wherein low wall sections are arranged on both end sections in an axial direction of the developer supplying member.

15. The image forming apparatus according to claim 8, wherein a width in an axial direction of the high wall section is less than a width of the developer supplying member.

* * * * *